US010870120B2

(12) United States Patent
Ruda

(10) Patent No.: US 10,870,120 B2
(45) Date of Patent: Dec. 22, 2020

(54) SPRAY GUN, LIQUID-CONDUCTING MEANS AND SET COMPRISING A LIQUID-CONDUCTING MEANS

(71) Applicant: Martin Ruda 1. UG (haftungsbeschraenkt)., Ostfildern (DE)

(72) Inventor: Martin Ruda, Ostfildern (DE)

(73) Assignee: Martin Ruda 1. UG (haftungsbeschraenkt)., Ostfildern (DE)

( * ) Notice: Subject to any disclaimer, the term of this patent is extended or adjusted under 35 U.S.C. 154(b) by 0 days.

(21) Appl. No.: 15/555,167

(22) PCT Filed: Mar. 4, 2016

(86) PCT No.: PCT/DE2016/000102
§ 371 (c)(1),
(2) Date: Sep. 1, 2017

(87) PCT Pub. No.: WO2016/138888
PCT Pub. Date: Sep. 9, 2016

(65) Prior Publication Data

US 2018/0050358 A1 Feb. 22, 2018

(30) Foreign Application Priority Data

Mar. 4, 2015 (DE) ..... 10 2015 002 684
Mar. 10, 2015 (DE) ..... 10 2015 002 950
(Continued)

(51) Int. Cl.
*B05B 7/24* (2006.01)
*B05B 7/02* (2006.01)
(Continued)

(52) U.S. Cl.
CPC ..... *B05B 7/2435* (2013.01); *B05B 7/02* (2013.01); *B05B 7/2408* (2013.01);
(Continued)

(58) Field of Classification Search
CPC ..... B05B 7/2478; B05B 7/02; B05B 7/067; B05B 7/247; B05B 9/01; B05B 7/2435; B05B 7/1263
(Continued)

(56) References Cited

U.S. PATENT DOCUMENTS 1,732,691 A * 10/1929 Mueller ..... B05B 7/0815 239/301
5,178,330 A * 1/1993 Rodgers ..... B05B 5/03 239/300
(Continued)

FOREIGN PATENT DOCUMENTS

CN 2614793 Y 5/2004
CN 201015754 Y 2/2008
(Continued)

OTHER PUBLICATIONS

International Search Report of PCT/DE2016/000102, dated Sep. 27, 2016.

*Primary Examiner* — Tuongminh N Pham
(74) *Attorney, Agent, or Firm* — Collard & Roe, P.C.

(57) ABSTRACT

A spray gun has a base body, a liquid-conducting device and a fastening nut, wherein the thread has a recess and the liquid-conducting device has at least one element which is radially projecting from a central liquid-conducting tube, the element fitting into the recess, so that, after unscrewing the fastening nut, the liquid-conducting device can be gripped at the projecting element in order to withdraw the liquid-conducting device from the base body. Further, a set
(Continued)

Figure 1:
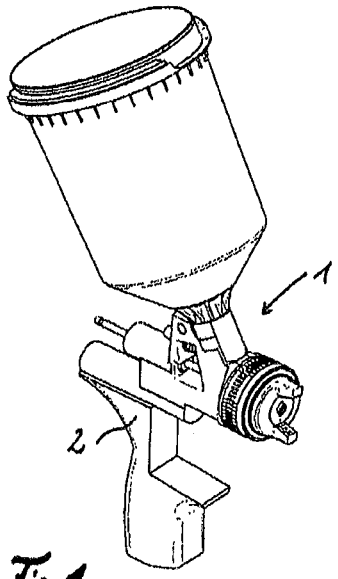

includes a liquid-conducting device with a liquid-conducting tube, in which is arranged a sleeve with a bore.

12 Claims, 17 Drawing Sheets

(30) Foreign Application Priority Data

| | | |
|---|---|---|
| Apr. 7, 2015 | (DE) | 10 2015 004 252 |
| Jul. 22, 2015 | (DE) | 10 2015 009 328 |
| Oct. 19, 2015 | (DE) | 10 2015 013 409 |
| Nov. 3, 2015 | (DE) | 10 2015 014 083 |
| Dec. 10, 2015 | (DE) | 10 2015 016 042 |
| Feb. 12, 2016 | (DE) | 10 2016 001 567 |

(51) Int. Cl.
*B05B 9/01* (2006.01)
*B05B 15/18* (2018.01)

(52) U.S. Cl.
CPC ..... *B05B 7/2478* (2013.01); *B05B 9/01* (2013.01); *B05B 15/18* (2018.02)

(58) Field of Classification Search
USPC ..... 239/290
See application file for complete search history.

(56) References Cited

U.S. PATENT DOCUMENTS

| | | | | |
|---|---|---|---|---|
| 5,794,323 | A * | 8/1998 | Galle | F16L 39/005 29/464 |
| 2002/0139300 | A1* | 10/2002 | Wlodarczyk | B05B 7/0876 118/302 |
| 2005/0145724 | A1 | 7/2005 | Blette et al. | |
| 2007/0262171 | A1* | 11/2007 | Wong | B05B 7/0815 239/296 |
| 2010/0187333 | A1 | 7/2010 | Escoto, Jr. et al. | |
| 2013/0320110 | A1 | 12/2013 | Brose et al. | |

FOREIGN PATENT DOCUMENTS

| | | | |
|---|---|---|---|
| DE | 10 2007 053 855 | A1 | 9/2008 |
| EP | 1 964 616 | A1 | 9/2008 |
| FR | 2863512 | B1 | 1/2006 |

* cited by examiner

DETAIL B
DETAIL C
DETAIL D
DETAIL E

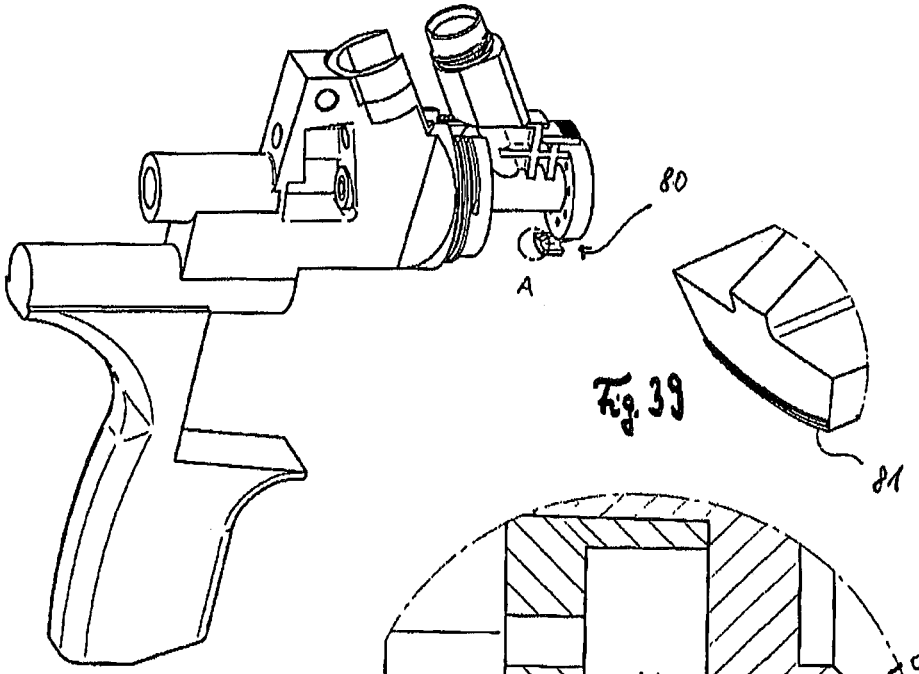
Fig. 38
Fig. 39
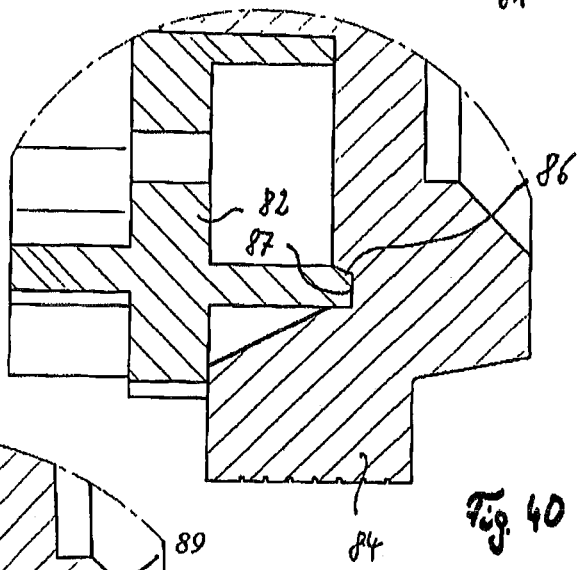
Fig. 40
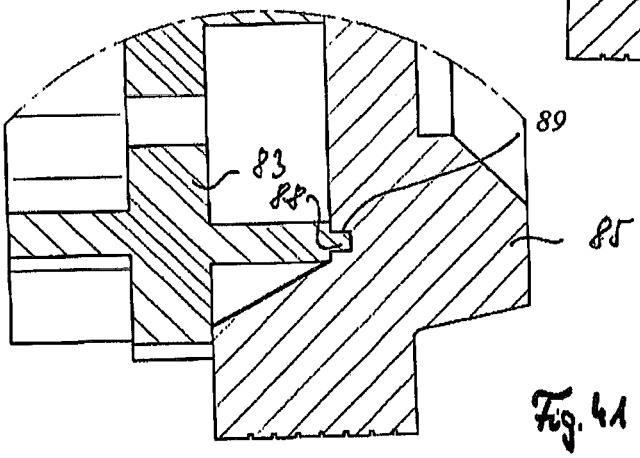
Fig. 41

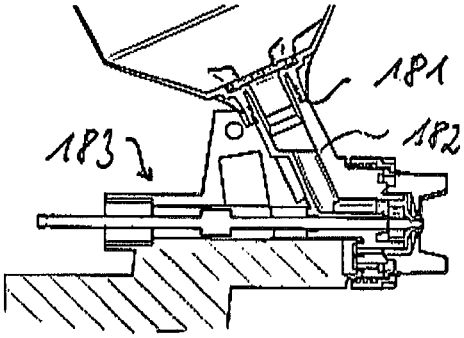
Fig. 61
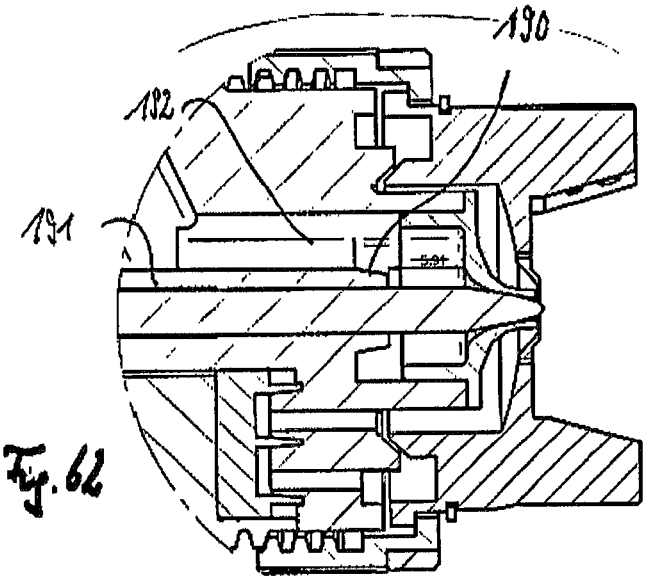
Fig. 62
Fig. 63
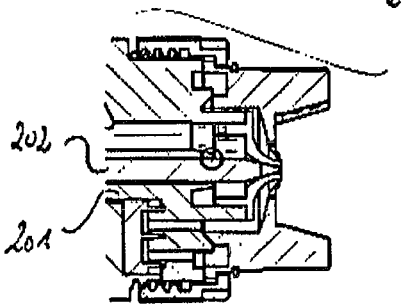
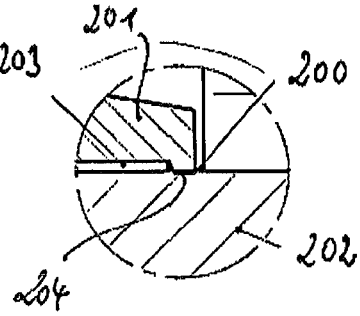
Fig. 64

SPRAY GUN, LIQUID-CONDUCTING MEANS AND SET COMPRISING A LIQUID-CONDUCTING MEANS

CROSS REFERENCE TO RELATED APPLICATIONS

This application is the National Stage of PCT/DE2016/000102 filed on Mar. 4, 2016, which claims priority under 35 U.S.C. § 119 of German Application Nos. 10 2015 002 684.4 filed on Mar. 4, 2015; 10 2015 002 950.9 filed on Mar. 10, 2015; 10 2015 004 252.1 filed on Apr. 7, 2015; 10 2015 009 328.2 filed on Jul. 22, 2015; 10 2015 013 409.4 filed on Oct. 19, 2015; 10 2015 014 083.3 filed on Nov. 3, 2015; 10 2015 016 042.7 filed on Dec. 10, 2015; and 10 2016 001 567.5 filed on Feb. 12, 2016, the disclosures of which are incorporated by reference. The international application under PCT article 21(2) was not published in English.

The invention relates to a spray gun, a liquid device and a set with a liquid conveying device.

A spray gun of the type in question, a liquid conveying device of the type in question and a set of the type in question are known from EP 1 964 616 A1.

A thread is also taken to mean a bayonet closure. Within the context of the invention the basis body and liquid conveying device are attached to each other with a device, such as a fastening nut for example.

The aim of the invention is to further develop such a spray gun, and in particular a spray gun for paints.

This aim is achieved with spray gun of the type in question with the features of described herein.

The contact surfaces arranged conically with regard to each other to form a receptacle for a counter-piece which is placed in the receptacle. As with a bottle cork the component with the contact surface can be inserted into the counter-piece in order to achieve a firm connection and seal. The elevation with the outlet and the contact surface arranged laterally with regard to the outlet can be formed on the liquid conveying device, whereas the recess is formed in the basic body. Alternatively to this the recess can also be formed in the liquid conveying device and take up an elevation formed in the basic body.

A further aspect of the invention relates to a spray gun which comprises a fastening nut (4) and in which the basic body has a thread (6) in order to connect the liquid conveying device (3) with the fastening nut (4) on the basic body (2), wherein the thread (6) has a recess (7) and the fluid conducting device (3) at least one element (9), radially projecting from a central liquid conveying pipe (8), which fits into the recess (7) so that after unscrewing the fastening nut (4) the liquid conveying device (3) can be grasped on the projecting element (9) in order to pull the liquid conveying device (3) from the basic body (2).

In place of a fastening unit a device, such as an annular element, can be used which holds the basic body and liquid conveying device together and is arranged on the liquid conveying device in such a way that the liquid conveying element can be grasped on the projecting end in order to pull the liquid conveying device from the basic body. The device can be also be mounted or held in a locking manner.

This allows the basic body and the fastening nut to be made of metal, whereas the liquid conveying device is made of a plastic material. The embodiment according to the invention enables a spray gun to be produced in which the largest proportion of the liquid conveying device is covered by metal parts. A liquid conveying device made of plastic is therefore externally protected by the metal parts and when the fastening nut is unscrewed the liquid conveying device can be easily grasped on the projecting elements in order pull it from the basic body.

A further aspect of the invention which, however, is also essential to the invention without the previously described features, relates to a spray gun of the type in question which has a paint needle which is arranged in the channel of the liquid conveying device, wherein a stripper is arranged between the channel and paint needle.

When using the spray gun for spraying paints, varnishes, adhesives, fillers or similar substances, spray guns are used in which a paint needle extends inside the liquid conveying device. This paint needle thus comes into contact with the liquid. When exchanging the liquid conveying device or the needle the needle remains soiled and, in particular in the case of a change of paint, must be cleaned.

It is therefore advantageous if a stripper is arranged between the channel and the paint needle. Such a stripper is in contact with the paint needle and on pulling out the paint needle or on pulling out the liquid conveying device scrapes over the paint needle in such a way that the paint needle is freed of paint residues. Through this cleaning of the paint needle either becomes obsolete or is at least greatly simplified.

A simple form of embodiment envisages that the stripper is inserted into the channel. As a stripper a rubber disk with a central hole can be used, for example, which surrounds the paint needle like a seal. Such a disk inserted into the hole, which can also me made of harder material and have a lip, is cost-effective to produce and can also be replaced if necessary.

As it is advantageous to produce the liquid conveying device as a disposable article, it is proposed to form the stripper in one piece with the liquid conveying device. The stripper can be made of the same material as the liquid conveying device. The shape of the stripper can thereby ensure contact with the paint needle without too strongly affecting the movability of the paint needle. The use of a dual component material for producing the liquid conveying device makes it possible to produce a stripper in a material optimised for its function.

Another aspect of the invention which can be used independently of the hitherto cited features envisages that an air distributor disk is screwed onto the basic body within which the liquid conveying device extends. This allows different air distribution disks to be used with the same liquid conveying device and the air distribution disk to be made of a different material from that of the liquid conveying device. In particular, the air distribution disk can be made of metal, whereas the liquid conveying device is made of plastic. Such an air distribution device either had a thread with which it can be screwed to the basic body, or it is screwed to the basic body with one or more screws which extend through holes in the air distribution disk.

A further aspect of the invention which can be used independently of the hitherto cited features envisages that the basic body comprises the air distribution disk. If the air distribution disk is produced as a single part it can be mounted on the basic body and adapt various basic bodies of spray guns to the paint conducting device. On the other hand an integrated embodiment with the basic body of the spray gun has the advantage that no separate air distribution disk is required. For this the structure required as the air distribution disk is formed directly in the basic body of the spray gun.

A further aspect of the spray gun which can be used independently of the hitherto cited features envisages that it comprises an air cap wherein the fastening nut pulls the air cap against the liquid conveying device in such a way that the air cap can still be turned when the fastening nut is screwed on. For this a fitting is provided which on the one hand allows the adjustment screw to be tightened firmly enough for the liquid conveying device to be securely fastened to the basic body, and on the other hand to tension an air cap in the fastening nut just enough so that it can still be turned when the fastening nut is screwed on.

The air cap does not have to be in contact with an annular surface, but can also be in contact with just one segment of an annular surface in order to be more easily rotatable.

In particular, in such an embodiment it is advantageous if the air cap has a contact surface with a locking element in order to lock into a certain position relative to the basic body. The contact surface with the locking element can interact with a counter-locking element on the fastening nut, on a nozzle or on the liquid conveying device, or on a displaceable pin.

Also independently of the aforementioned features, an embodiment is advantageous in which the basic body of a spray gun and a liquid conveying device form an annular pressing surface for a fastening nut, wherein the not yet firmly screwed-on liquid conveying device protrudes in a partial area of the pressing surface with regard to the remaining area of the pressing surface. In practice the liquid conveying device is inserted into the basic body and this results in part of the pressing surface protruding with regard to the remainder of the pressing surface. Only through screwing on the fastening nut is this protruding part pushed into the plane of the remaining part of the pressing surface, whereby the liquid conveying device is pressed against the basic body so that a seal is formed between the basic body and the liquid conveying surface.

Additionally or alternatively the liquid conveying device can have a protruding element which on screwing on of the fastening nut engages in the thread of the fastening nut so that on being screwed on the fastening nut presses the liquid conveying device to the basic body. The protruding element can have oblique contact surfaces which facilitate engagement with the thread so that the protruding element is guided into a recess of the thread when the fastening nut is screwed on.

It is also advantageous if contact surface between the liquid conveying device and the basic body or a component of the basic body form a seal and between the contact surfaces openings are provided which make possible an externally sealed passage from the basic body of the spray gun to an air cap.

Independently of the aforementioned features it is advantageous if for fastening a liquid conveying device to the basic body of a spray gun the contact surfaces between the liquid conveying device and the basic body are arranged in such an oblique manner to the alignment of the liquid pipe that on the basic body an conical receptacle for the liquid conveying device is produced. The liquid conveying device can then, for example by means of the fastening nut, be pushed into the basic body, wherein the oblique contact surfaces of the liquid conveying device are pushed into the cone of the basic body. Through this, in a simple manner a good seal is produced in a large area which also extends in parallel to the liquid pipe.

In order to be able to easily remove the liquid conveying device from the basic body again, according to a further aspect, which is independent of the previously cited features, it is proposed to arrange an axially displaceable pin in the basic body. With this pin a pressure can be exerted on the liquid conveying device. On axial displacement of the pin one end of the pin can thus press on the liquid conveying device in order to remove the liquid conveying device from the basic body.

Such a pin can have a contact surface, which is decentral in relation to its central axis, for contacting the liquid conveying device. This allows the pin to be decentrally displaced in relation to the liquid conveying pipe of the liquid conveying device and to press on the liquid conveying device in the proximity of the liquid conveying pipe. Through this, on pressing the pin onto a special position of the liquid conveying device tilting of the liquid conveying device can be minimised when being pressed out.

The object forming the basis of the invention is also achieved with a liquid conveying device which can be used for a spray gun of this type. This liquid conveying device has a liquid supply pipe which opens out into liquid conveying pipe and is characterised by the features of claim 18.

The angle results in conical contact surfaces between which an air passage is provided and depending on the pressure make for particularly firm contacting and thus allow special tightness to be achieved.

The contact surfaces can be U-shaped or quadrilateral. It is advantageous if they are arranged concentrically to the axis of the liquid conveying pipe and/or in parallel to each other.

An elevation can be provided between the contact surfaces of the liquid conveying device in which the opening is provided, so that this elevation can be inserted into a corresponding recess of the basic body. Alternatively the recess can also be provided in the liquid conveying device into which an elevation of the basic body can be inserted.

According to other aspect of the invention the liquid conveying device has a paint needle channel for a paint needle and, radially at a distance therefrom, as a liquid conveying pipe a paint channel for a spray medium. Between the paint needle channel and the liquid conveying pipe there is therefore a wall which prevents the soiling of the paint needle with liquid.

It is advantageous if the paint channel extends from the liquid supply pipe, separated by a wall separated from the paint needle channel, up to the outlet from the liquid conveying device.

It is advantageous if a bushing is arranged in the liquid conveying pipe before the opening in the flow direction. This bushing is preferably made of plastic. It can be screwed or adhered into the liquid supply pipe. Preferably the bushing is held in the liquid conveying pipe by means of press fitting.

In order to facilitate positioning of the bushing in the liquid conveying pipe it is proposed that the bushing has a radial stop or a flange. This allows the bushing to be pushed so far into the liquid conveying pipe until the radial stop or flange contacts the liquid conveying pipe.

It is advantageous if a stripper is arranged in the bushing. This stripper can interact with a paint needle in order to strip liquid from the surface of the paint needle during a relative movement between the paint needle and bushing.

This stripper can be formed by a perforated disk. Such a perforated disk either has a fine lip seal as a stripper or is made of a softer material, rubber for instance. This allows the paint needle to be cleaned with the perforated disk.

Such a perforated disk can be fastened in a recess of the bushing and preferably lock into place there, but can also be produced during injection moulding so that a bushing made of a dual component material is produced, or a softer material is injected into a recess in the bushing so that an annular perforated disk is produced which is integral with the bushing and therefore firmly connected to the bushing.

It is particularly advantageous if the stripper is formed by a flange extending radially inwards from the bushing. This flange is preferably formed in one piece with the bushing. Even a small annular elevation produced in the injection moulding process which protrudes above the cylindrical inner surface of the bushing allows annual contacting of the bushing on a paint needle, while the paint needle can be freely displaced in the remaining area of the bushing.

A further development of the liquid conveying device envisages that a nozzle is arranged in the liquid conveying pipe after the opening in the direction of flow. This nozzle can be formed in one piece with the liquid conveying pipe or can be attached to the liquid conveying pipe.

It is advantageous if the nozzle is fastened in the liquid conducing pipe through press fitting. Alternatively or additionally the nozzle can also be fastened in the liquid conveying pipe with a thread.

Depending on the variant of embodiment it is advantageous if the nozzle comprises an air distribution disk. The air distribution disk can also be formed in one piece with the liquid conveying pipe or be fastened to the liquid conveying pipe by press fitting. A screw connection is also possible.

In order to pull the liquid conveying device out of the basic body of a spray gun in a simple manner, it is proposed that a crosspiece extends radially outwards from the liquid supply pipe and has grip area at the end. Advantageously at least two opposite grip surfaces are provided which can also be designed a pull loops.

A special form of embodiment envisages that pressure on the grip surface leads to a deformation of the liquid conveying device through which the liquid conveying device presses at point on the basic body of a spray gun in order to release the liquid conveying device from the basic body.

The liquid supply pipe can have a radially outward extending flange with air holes. This radial flange with air holes can act as an air distribution disk or just allow the passage of air in a flow parallel to the liquid supply pipe.

It is advantageous if in one area of the outer surface of the flange extending radially outwards there is a crosspiece, at the end of which a grip surface is arranged. The liquid conveying device can then, for example, be held by a grip surface on the liquid supply pipe and on the flange extending radially outwards in order pull it from the basic body of a spray gun.

After the spraying, the spray gun tank is usually unscrewed from the liquid conveying device and emptied and cleaned of closed in an air-tight manner to store the remaining paint. The liquid conveying device is cleaned or disposed of and on the basic body of the paint spray gun the paint needle is cleaned. According to the invention it is proposed that after spraying the liquid conveying device together with the spray gun tank is removed from the basic body of the spray gun and the two remaining openings as inlet and outlet the liquid conveying pipe are closed. For this it is proposed that on the opposite site the liquid conveying device has an inlet and an outlet and a closing device, wherein the closing device closes the inlet and the outlet. In order to place the spray gun tank with the liquid conveying device pointing upwards, the air flow opening is closed in flow tanks. The flow tank can then also be placed on its cover. In this way the spray gun tank with screwed on liquid conveying device is sealed for storage in an air-tight manner.

Whereas the tank, and in particular a flow tank, can be closed with a simple stopper, two openings on the liquid conveying device have to be closed if the tank is closed with the liquid conveying device. For this it is envisaged that the closing device has two covers, stoppers or screw closures. It is advantageous if the covers, stoppers or screw closures are identically designed so that different closing devices do not have to be kept in store.

A particularly preferred variant of embodiment allows both openings of the liquid conveying device to be closed with one closing means. For this it is proposed that the closing device has a spike which closes the inlet and outlet. This spike can be inserted like a paint needle into the liquid conveying device and locking areas or fits ensure an adequate air-tight seal. It must be ensured that the spike does not produce a seal at not quite tight points through drying of the paint. On removal of the spike the openings are opened again so that the tank with the liquid conveying device can be inserted into the spray gun basic body.

As the spike the paint needle or part of the paint needle can be used. If the paint needle can be removed from the spray gun or the paint needle can be divided, so that the forward apart of the paint needle can be removed from the rear part, it is possible for the spike to be part of the paint needle. The closing device, and in particular the spike, can preferably be made of a plastic material. The closing device can then be designed as a disposable component which after spraying together with the liquid conveying device serves as an air-tight seal of the paint outlet of the spray gun tank.

Suitable as a dividable paint needle is, for example, a paint needle as described in DE 10 2007 053 855 A1. Reference to the full contents of this document is made. In the same way as axial displacement means of the paint needle can be combined with the paint needle, paint needles or a part of the paint needle can be separated from the basic body of the spray gun in order to be use as closing means after spraying.

According to the invention an method is therefore provided in which a liquid conveying device is part of a spray gun during spraying and after spraying is preferably removed together with the tank from the spray gun in order to be used as a closure and closable paint reservoir respectively.

The statements relating to the closure device and its use are also essential to the invention without the previously described features.

In order to make it easier for the user to select the correct nozzle in the case of a liquid conveying device, a set with a liquid conveying device is proposed which has a liquid conveying pipe, in which a nozzle with a boring is arranged. According to the invention the set comprises various nozzles with different boring diameters, wherein nozzles with different boring diameter are of different colours.

Alternatively a set with several liquid conveying devices is proposed which have various nozzles with different boring diameters, wherein liquid conveying devices with different nozzle are of different colours. From various liquid conveying devices the user can therefore select a particular one with a certain boring diameter, wherein its colour immediately shows him/her the boring diameter of the nozzle of the liquid conveying device.

Other aspects of spray guns and liquid conveying devices are also described.

Figure 2:
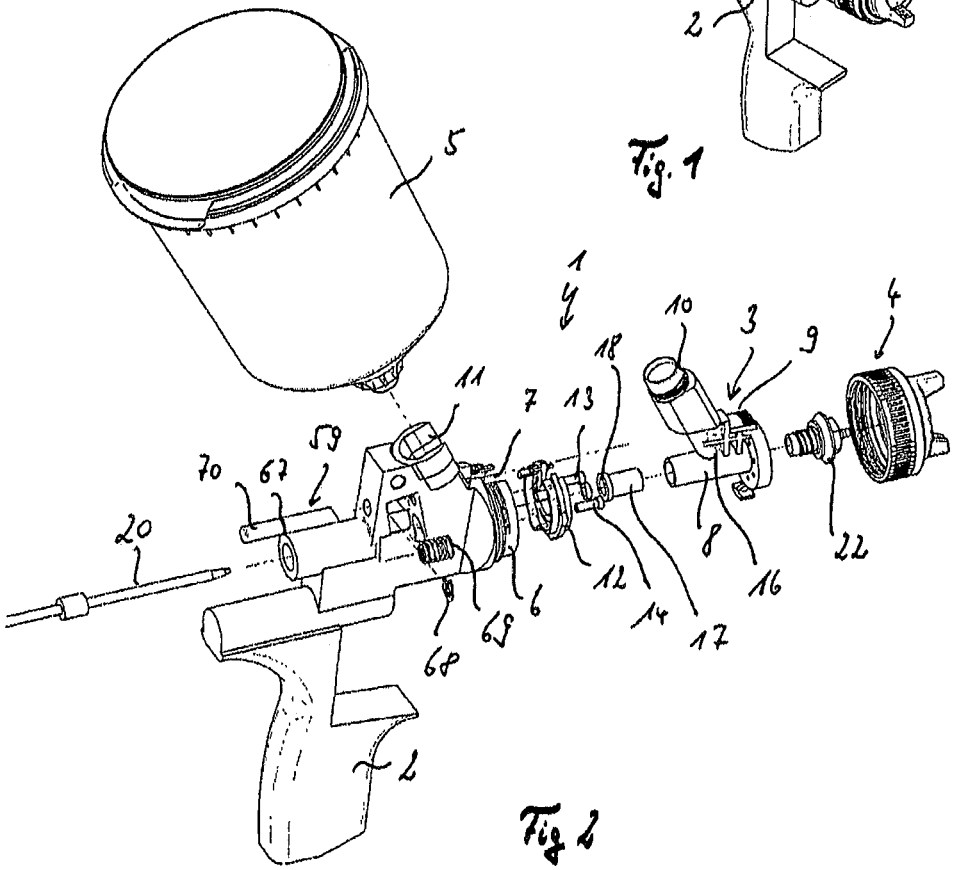
Figure 3:
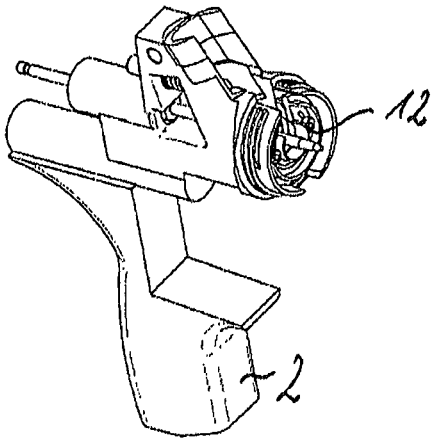
Figure 4:
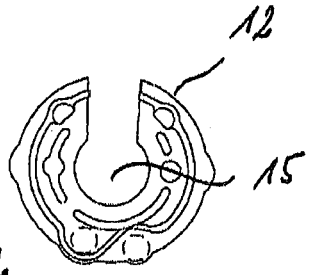
Figure 5:
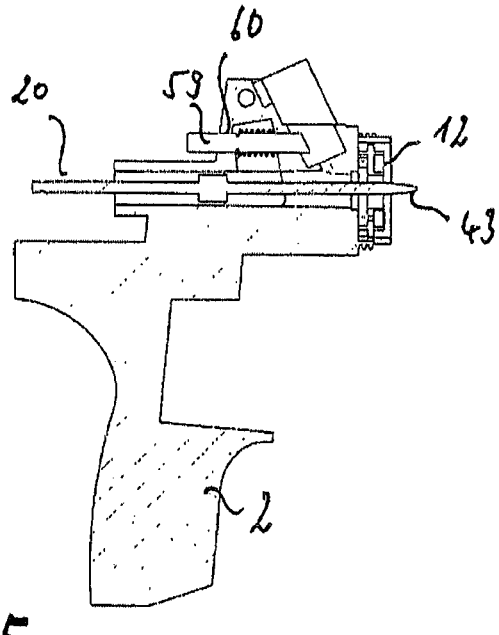
Figure 6:
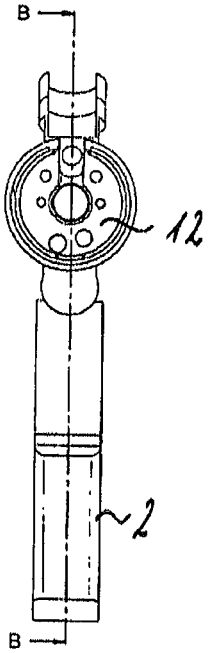
Figures 7, 8, 9, 10, 11, 12, 13, 14:
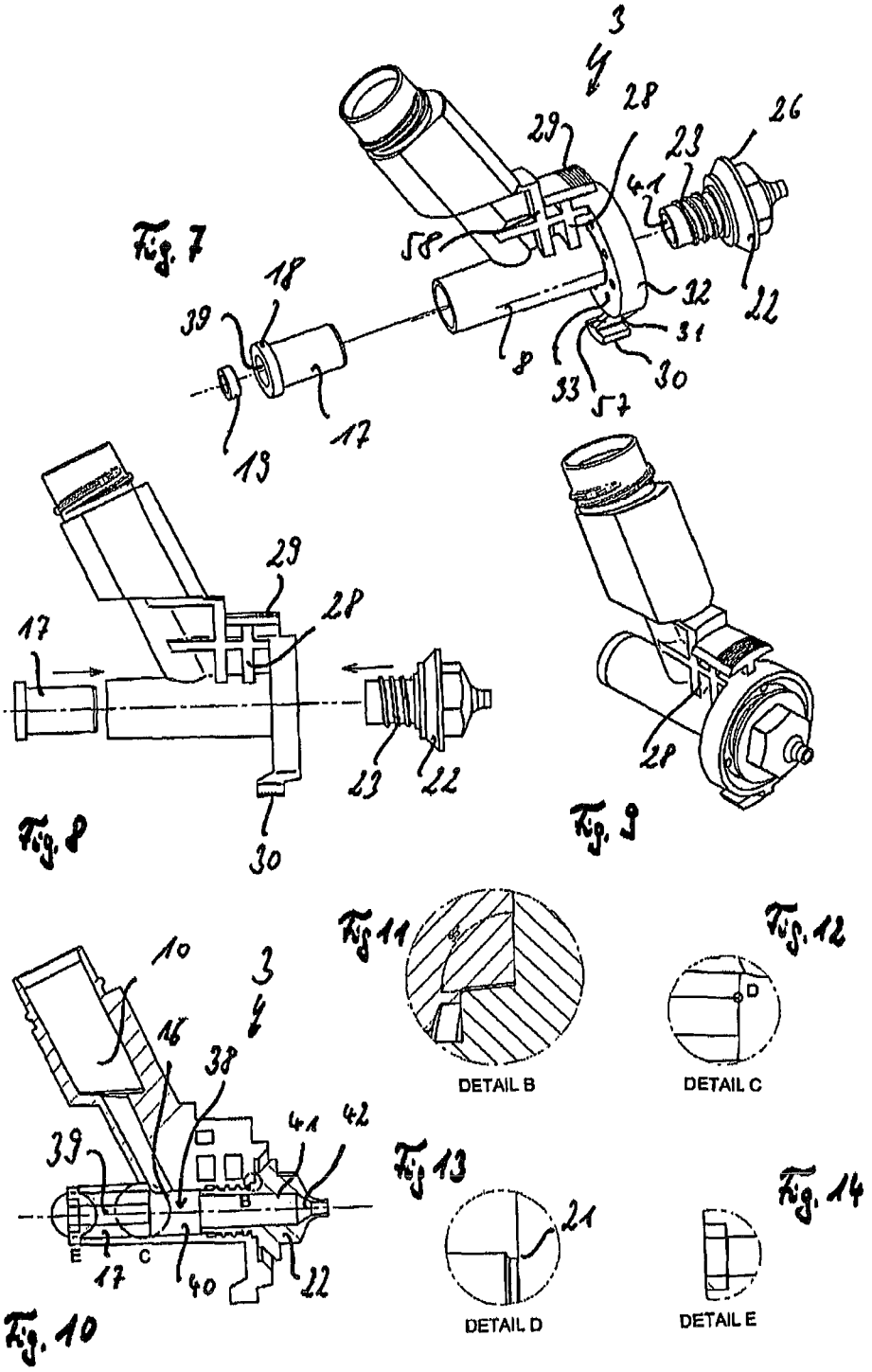
Figure 15:
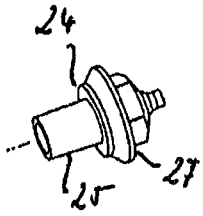
Figure 16:
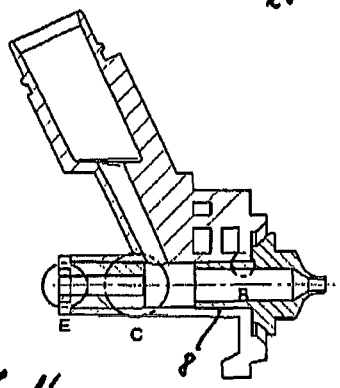
Figure 17:
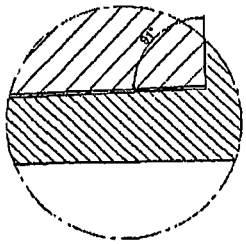
Figure 18:
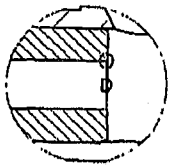
Figure 19:
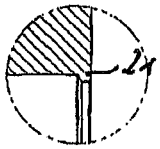
Figure 20:
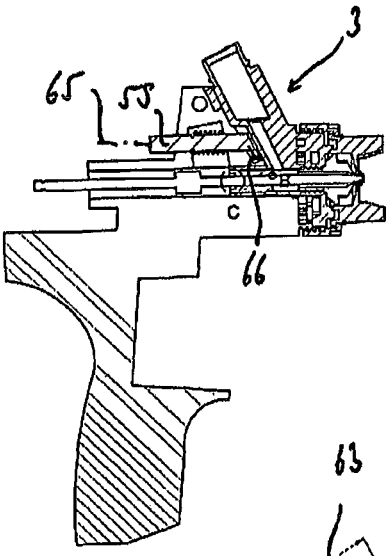
Figure 21:
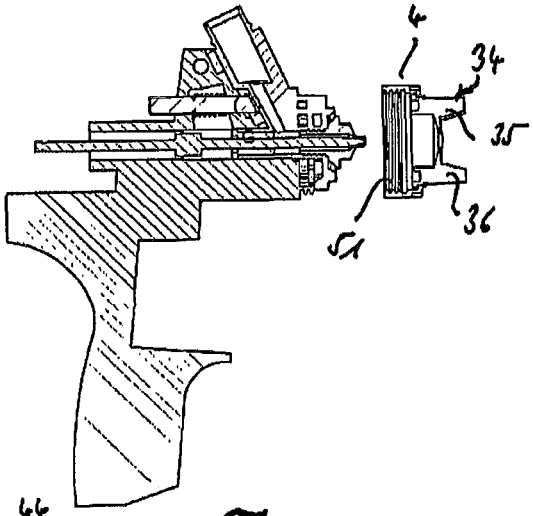
Figure 22:
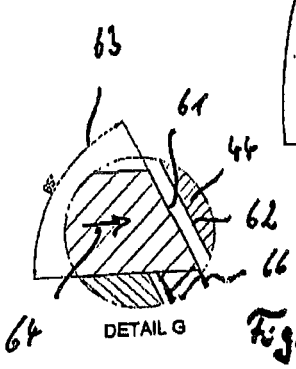
Figure 23:
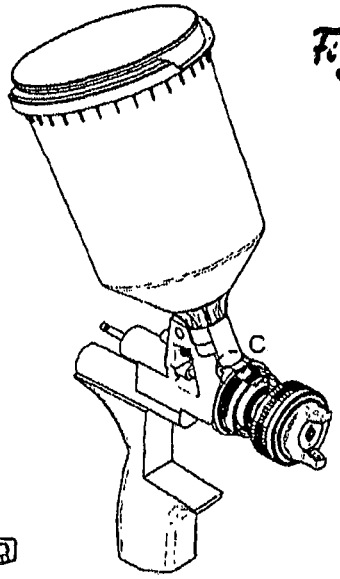
Figure 24:
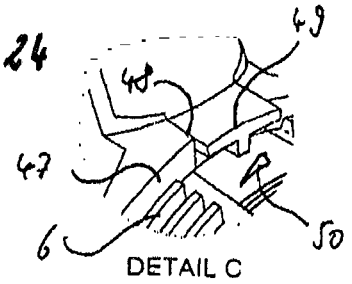
Figure 25:
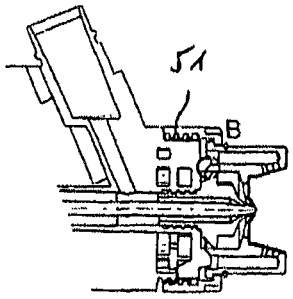
Figure 26:
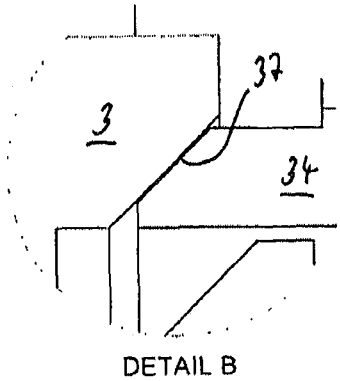
Figure 27:
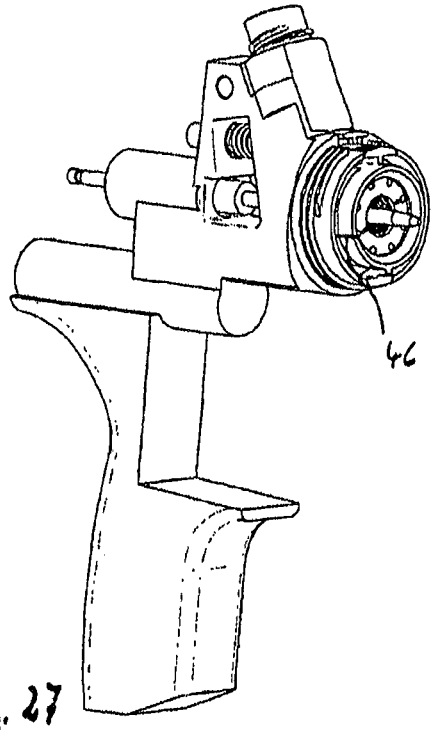
Figure 28:
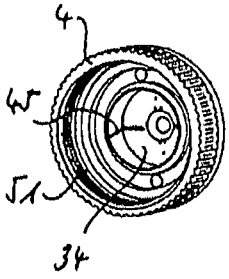
Figure 29:
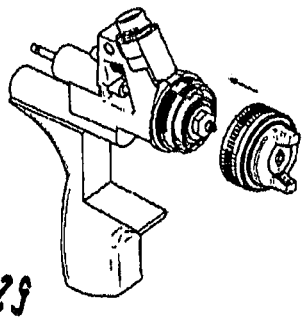
Figure 30:
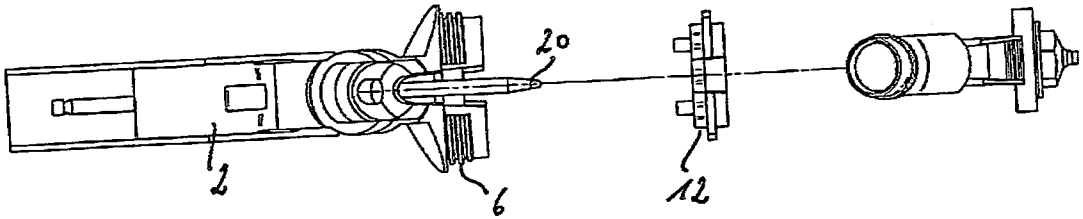
Figure 31:
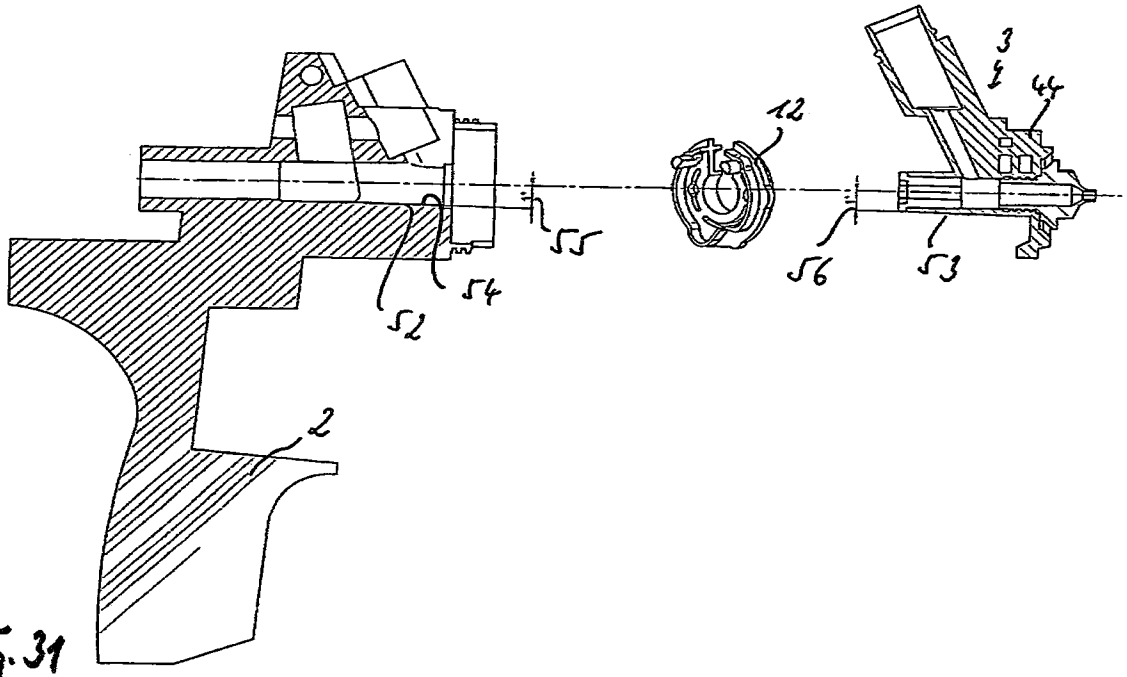
Figure 32:
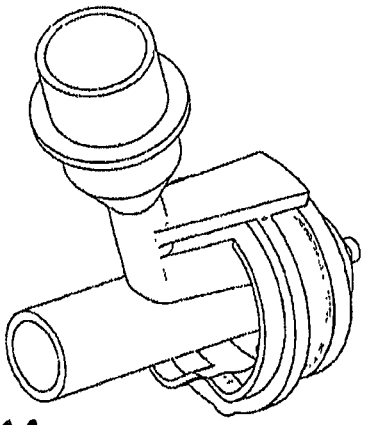
Figure 33:
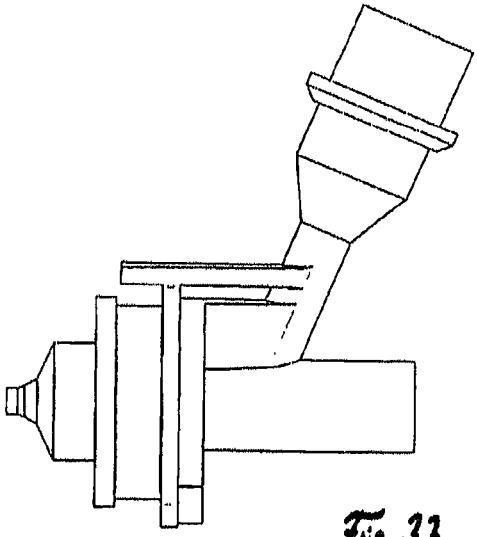
Figure 34:
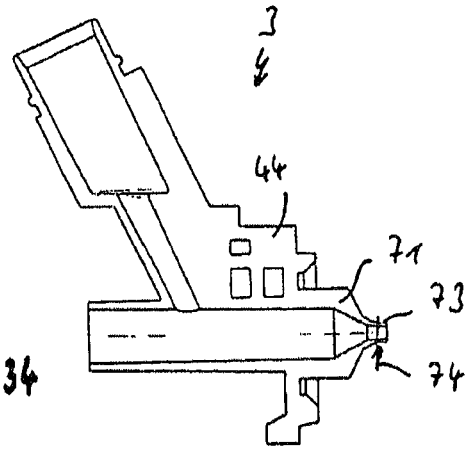
Figure 35:
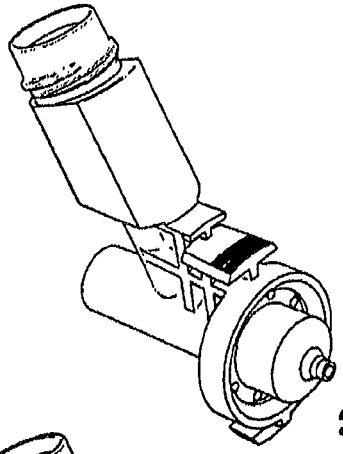
Figure 36:
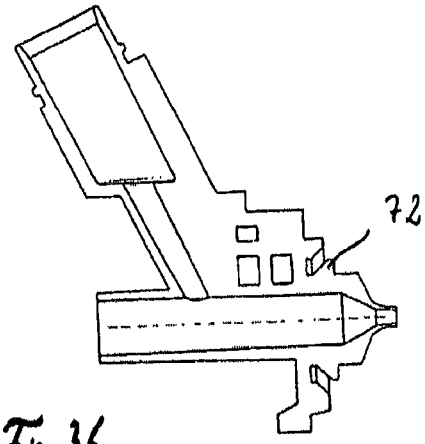
Figure 37:
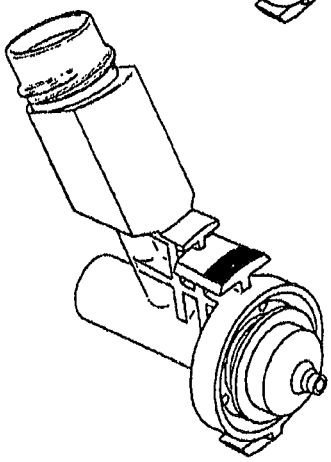
Figure 42:
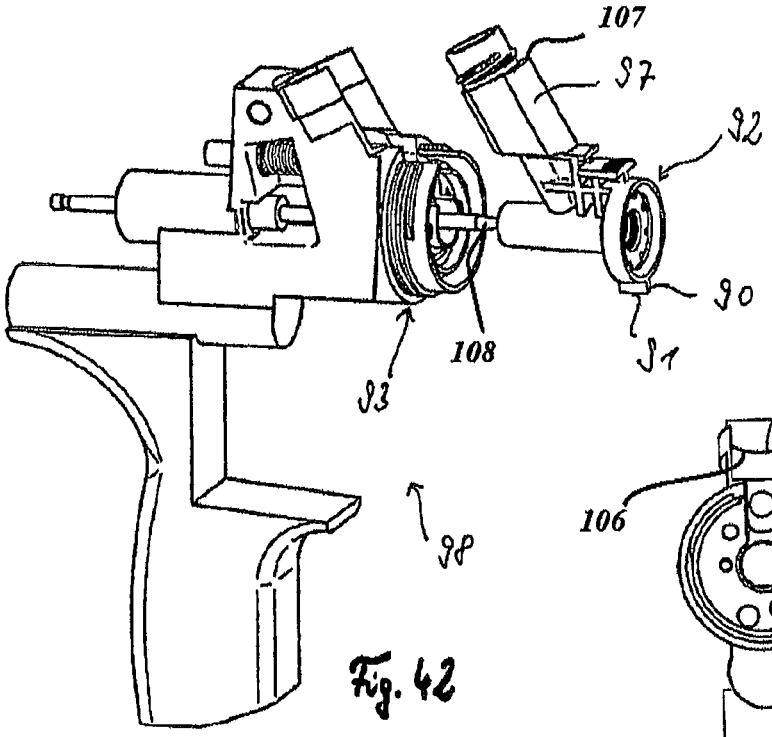
Figure 43:
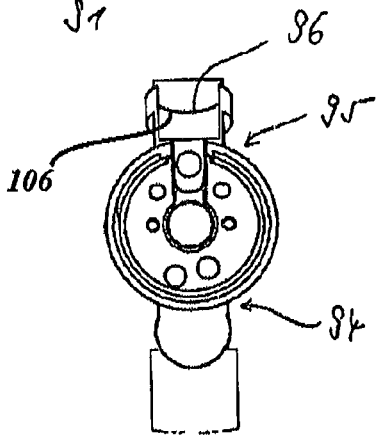
Figure 44:
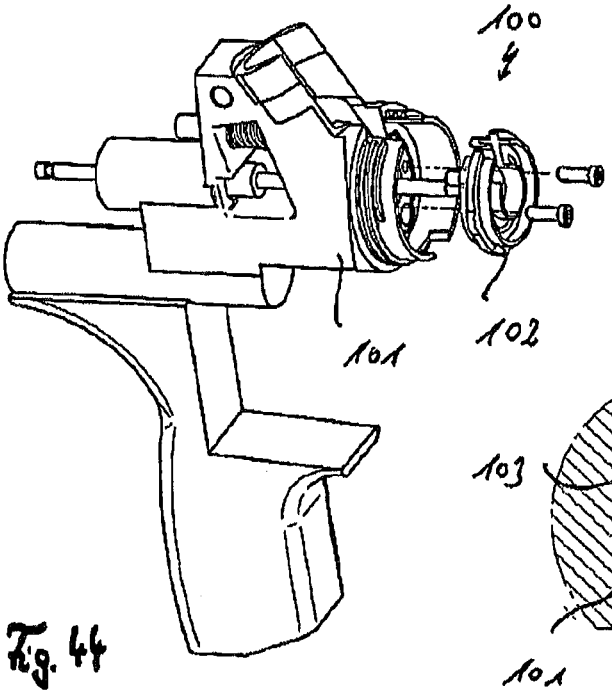
Figure 45:
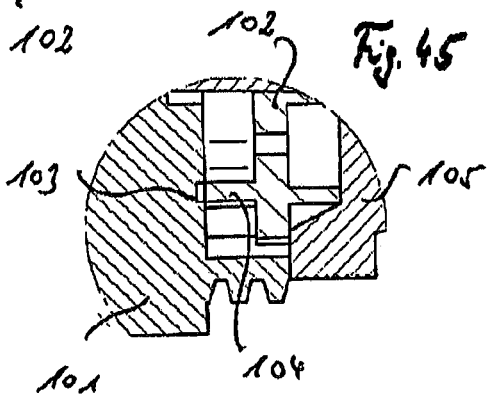
Figure 46:
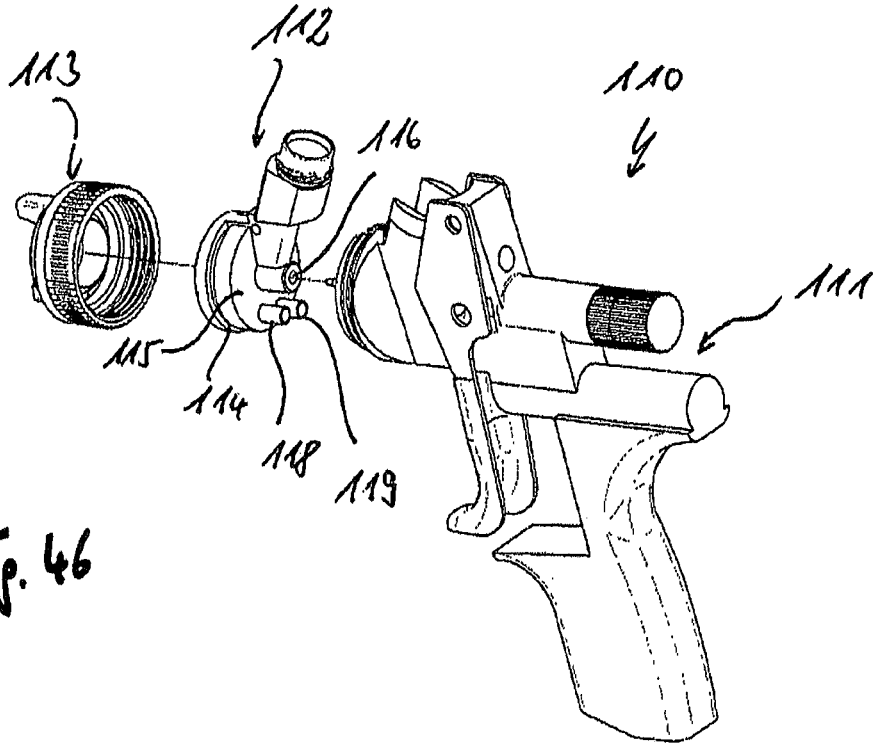
Figure 47:
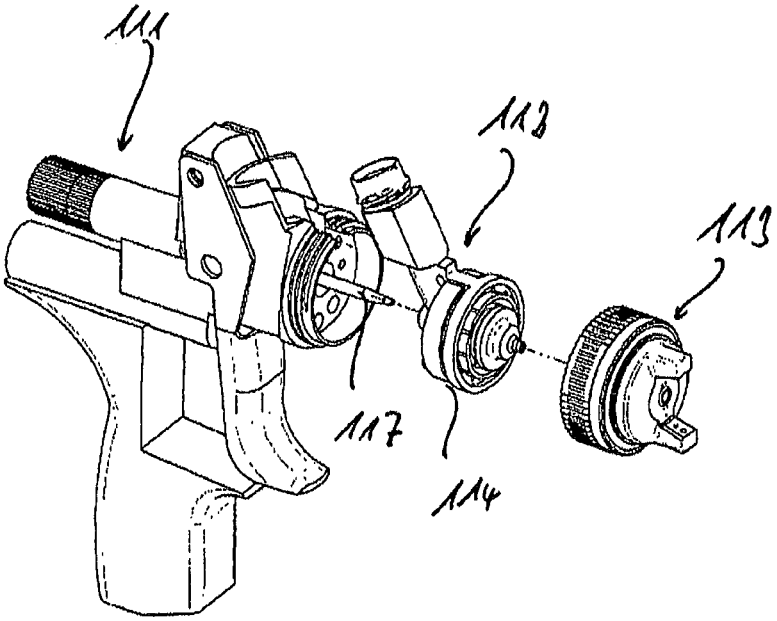
Figure 48:
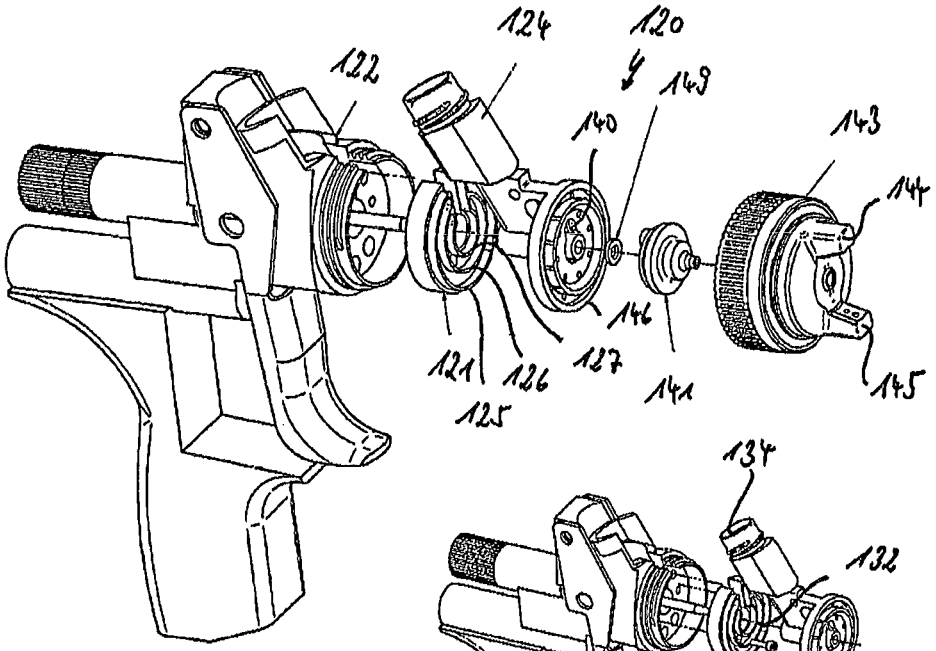
Figure 49:
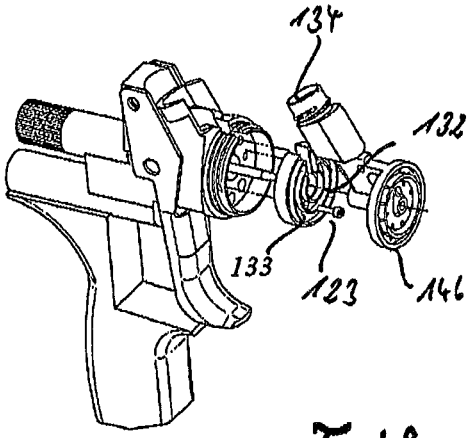
Figure 50:
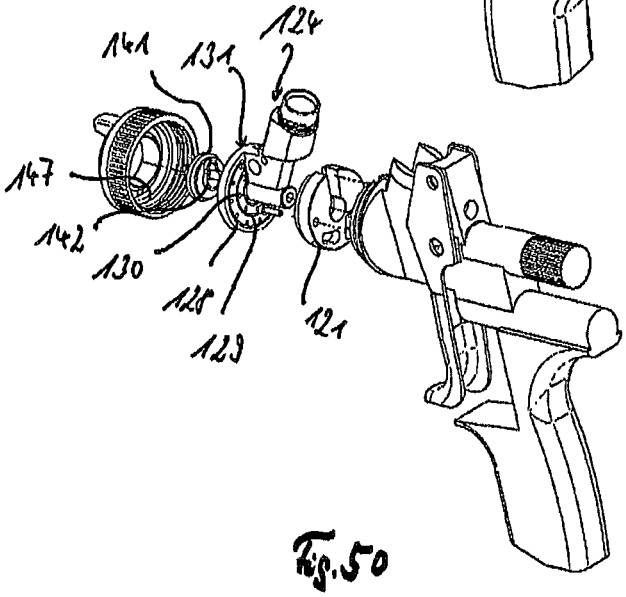
Figure 51:
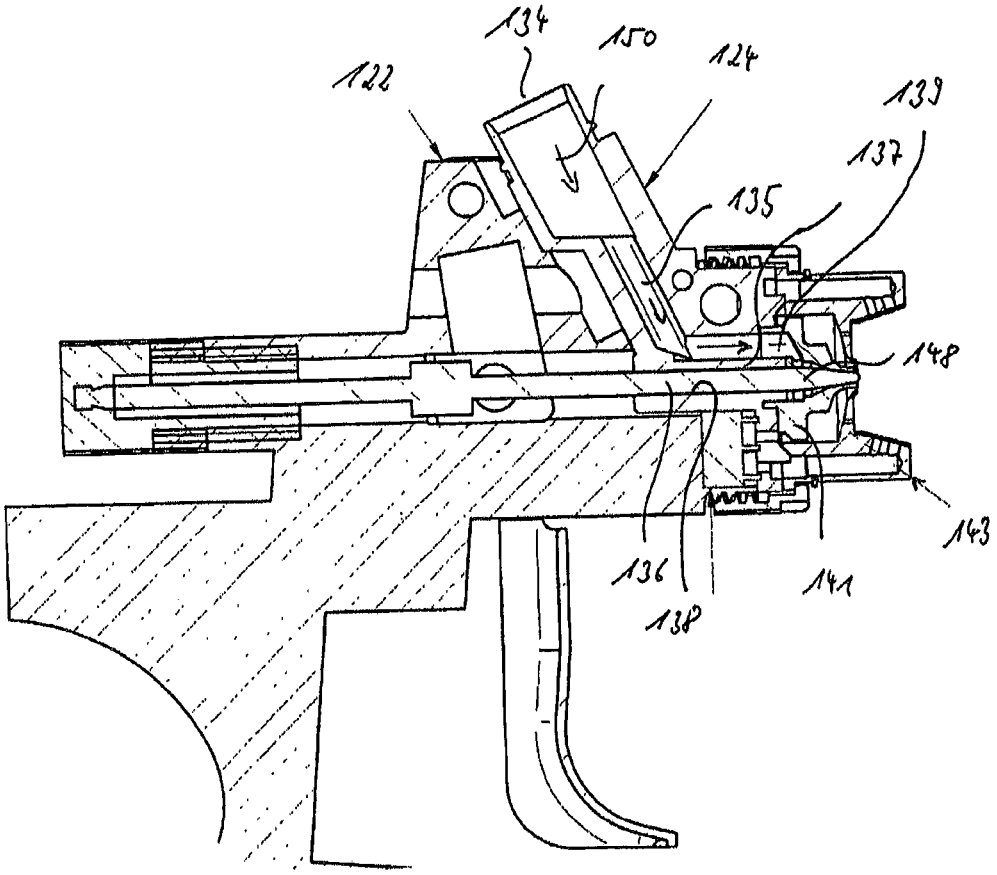
Figure 53:
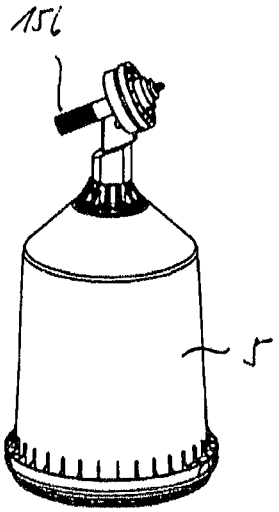
Figure 54:
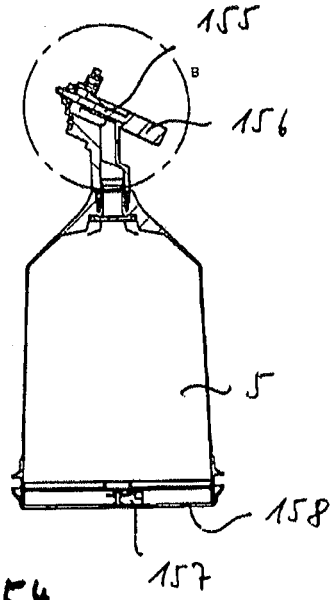
Figure 55:
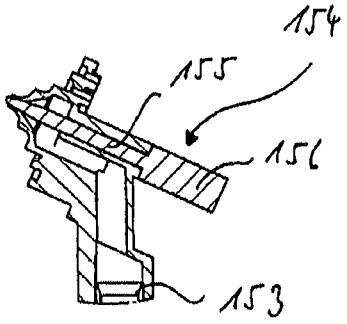
Figure 56:
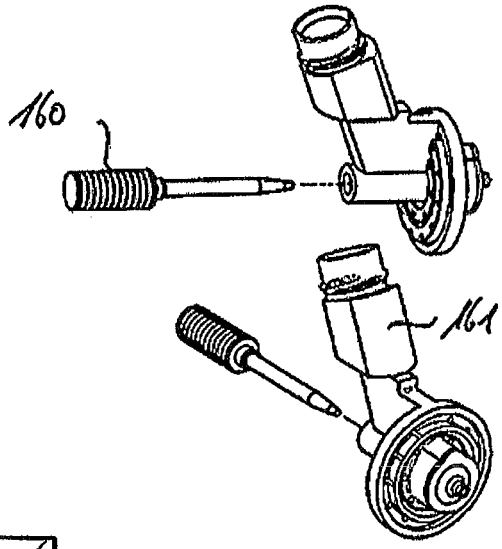
Figure 57:
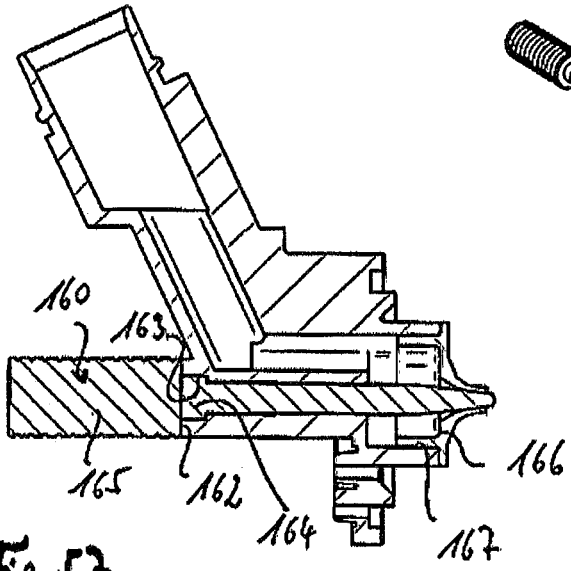
Figure 58:
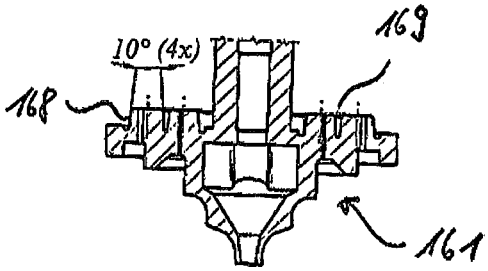
Figure 59:
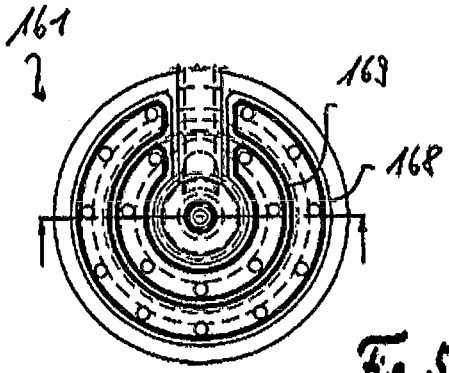
Figure 10:
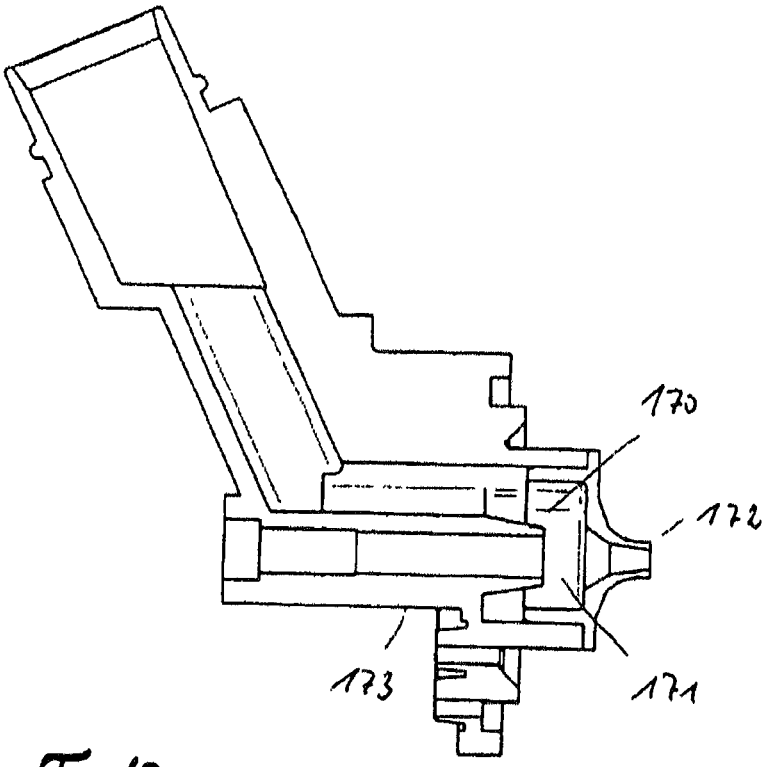
Figure 65:
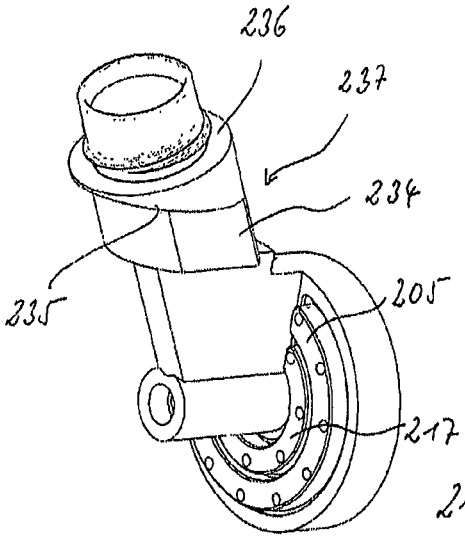
Figure 66:
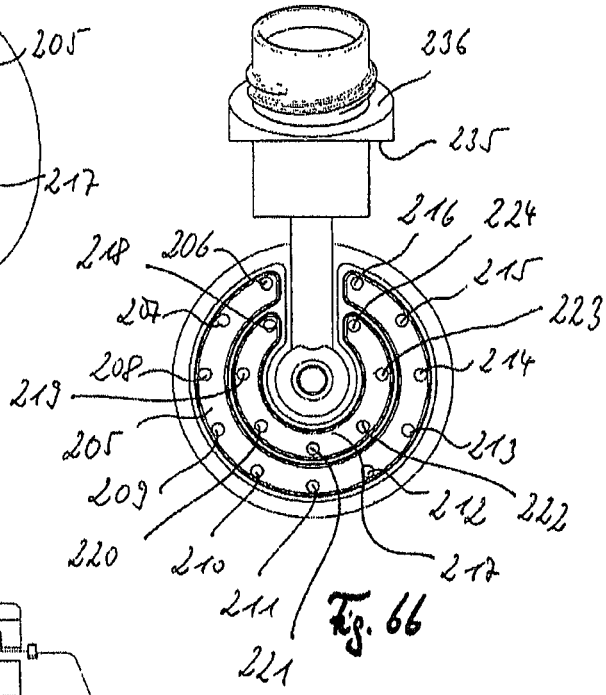
Figure 67:
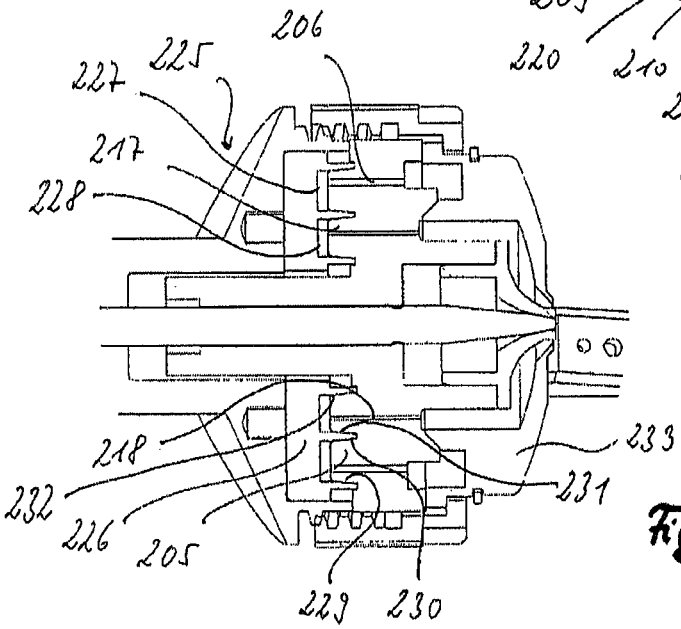

Examples of embodiment of spray guns and liquid conveying devices according to the invention are set out in the drawing and described in more detail below. In these FIG. 1 shows a perspective view of a spray gun, FIG. 2 shows an exploded view of the spray gun shown in FIG. 1, FIG. 3 shows a perspective view of a spray gun with an air distribution disk, FIG. 4 shows a view of the rear side of the air distribution disk, FIG. 5 shows a cross-section through the spray gun shown in FIG. 3, FIG. 6 shows a front view of the spray gun shown in FIG. 3, FIG. 7 shows a exploded view of a liquid conveying device with screwed-on nozzle, FIG. 8 shows a side view of the liquid conveying device show in FIG. 7, FIG. 9 shows a front view of the liquid conveying device shown in FIG. 7, FIG. 10 shows a cross-section through the liquid conveying device shown in FIG. 7, FIG. 11 shows an enlarged view of detail B shown in FIG. 10, FIG. 12 shows an enlarged view of detail C shown in FIG. 10, FIG. 13 shows an enlarged view of detail D shown FIG. 12, FIG. 14 show an enlarged view of detail E shown in FIG. 10, FIG. 15 show a nozzle for press fitting FIG. 16 shows a section through a liquid conveying device with a nozzle with press fitting, FIG. 17 shows an enlarged view of detail B shown in FIG. 16, FIG. 18 shows an enlarged view of detail C shown in FIG. 16, FIG. 19 shows an enlarged view of detail D shown in FIG. 18, FIG. 20 shows a cross-section through a spray gun with screwed-on fastening nut FIG. 21 shows a cross-section through a spray gun with the fastening nut unscrewed FIG. 22 shows an enlarged view of detail G shown in FIG. 21, FIG. 23 shows a perspective view of a spray gun with the fastening nut unscrewed, FIG. 24 shows an enlarged view of detail C shown in FIG. 23, FIG. 25 shows part of a cross-section of the spray gun shown in FIG. 23 with the fastening nut screwed on, FIG. 26 shows an enlarged view of detail B shown in FIG. 25, FIG. 27 shows a perspective view of the spray gun shown in FIG. 23, FIG. 28 shows a perspective view of the rear side of the fastening unit with inserted air cap, FIG. 29 shows a perspective view of the spray gun shown in FIG. 23 with the fastening nut with air cap, FIG. 30 shows a view from above of a spray gun with a basic body, air distributor disk and liquid conveying device, FIG. 31 shows a section through the spray gun shown in FIG. 30, FIG. 32 shows a perspective view of a liquid conveying device with integrate nozzle, FIG. 33 shows a side view of the liquid conveying device shown in FIG. 32, FIG. 34 shows a cross-section through a further liquid conveying device with integrated nozzle, FIG. 35 shows a perspective view of the liquid conveying device shown in FIG. 34, FIG. 36 shows a cross-section through a liquid conveying device with a nozzle and air distributor ring, FIG. 37 shows a perspective view of the liquid conveying device according to FIG. 36, FIG. 38 shows a perspective view of a spray gun, FIG. 39 shows an enlarged view of detail A in FIG. 38, FIG. 40 shows an example of a groove-spring connection with chamfered groove, FIG. 41 shows an example of a groove-spring connection a stepped groove, FIG. 42 shows a perspective view of a spray gun, FIG. 43 shows a front view of the spray gun shown in FIG. 42, FIG. 44 shows a perspective view of a spray gun, FIG. 45 shows an enlarged cross-section in the area of the air distributor disk, FIG. 46 shows a perspective view of a spray gun with encapsulated air passage, FIG. 47 shows a further view of the spray gun shown in FIG. 46, FIG. 48 shows a exploded view of a spray gun with spray medium conducting at a distance from the paint needle, FIG. 49 shows the fastening of the air distributor disk in the basic body of the spray gun, FIG. 50 shows an exploded rear view of the spray gun shown in FIG. 48, FIG. 51 shows a cross-section through the spray gun shown in FIGS. 48 to 50, FIG. 52 shows a view of a spray gun tank with screwed on liquid conveying device and spike, FIG. 53 shows a view of the liquid conveying device with the inserted spike, FIG. 54 shows a cross-section through the liquid conveying device shown in FIG. 52 with the spike inserted, FIG. 55 shows an enlarged view of the liquid conveying device shown in FIG. 54, FIG. 56 shows two views of a liquid conveying device with spike, FIG. 57 shows a cross-section through the liquid conveying device shown in FIG. 56, FIG. 58 shows a cross-section through a front area of the liquid conveying device shown in FIG. 57, FIG. 59 shows a view from above of rear of the liquid conveying device shown in FIG. 57, FIG. 60 shows a cross-section through a liquid conveying device with a paint needle cover, FIG. 61 shows a cross-section through a spray gun with paint tank, FIG. 62 shows a detail of the front area of a spray gun in cross-section, FIG. 63 shows a cross-section of the front area of a spray gun, FIG. 64 shows an enlargement of the detail shown in FIG. 63, FIG. 65 shows a perspective view of the side of the paint conveying device, FIG. 66 shows a perspective view of the rear of the paint conveying device shown in FIG. 65, and FIG. 67 shows s cross-section through the paint conveying device shown in FIG. 65.

The spray gun 1 shown in FIG. 1 comprises a basic body 2, a liquid conveying device 3 and a fastening nut 4. A paint tank 5 can be fastened to the spray gun 1. Through screwing the fastening nut 4 to a thread of the basic body 2 the liquid conveying device 3 is fastened to the basic body 2. The thread 6 has a recess 7 and the liquid conveying device 3 has an element 9 protruding from its central liquid conveying pipe 8 which can be inserted into the recess 7. Through this the liquid supply pipe 10 of the liquid conveying device 3 is inserted into a recess 11 of the basic body 2.

The paint tank 5 can be fastened directly to the liquid supply pipe 10 or is connected to the liquid conveying device by way of an adapter. The adapter allows various paint conveying devices to be combined with different paint tanks. The paint tank 5 can screwed on, mounted or fastened with a locking closure. Suitable as a locking closure is a click closure which clicks into place audibly and/or palpably in order to indicate to the user that the paint tank 5 is securely attached and preferably even sealed. It is advantageous if a stabilising sleeve surrounds the closure.

After unscrewing the fastening nut 4 the liquid conveying device 3 can be gripped on the projecting element 9 in order to pull the liquid conveying device 3 from the basic body 2.

An air distributor 12 is screwed onto the basic body 2 by means of screws 13, 14. This air distributor 12 has a central recess 15 within which the liquid conveying device 3 extends.

The liquid conveying device 3 has an opening 16 at which the liquid supply pipe 10 opens out into the liquid conveying pipe 8. Arranged before this opening 16 in the direction of flow is a bushing 17 with a flange 18 which is press fitted in the liquid conveying pipe 8. Fastened within the bushing 17 is an annular rubber disk 19 as a stripper for the paint needle 20. This rubber ring is arranged approximately in the area of the flange 18 and forms a stripper for the paint needle 20 at the point of entry of the needle 20 into the bushing 17.

At the point of exit of the needle 20 from the bushing 17 an inwardly radially extending flange 21 is provided on the inside of the bushing 17 which at this point of the bushing 17 wipes the paint needle 20. During the production of the bushing this flange 21 is made of the bushing material in an injection moulding process.

In the direction of flow, a nozzle 2 with a thread 23 is fastened in the liquid conveying pipe 8 at the front end of the liquid conveying device 3. In the alternative form of embodiment shown in FIGS. 15 to 19, a nozzle 24 is fastened in the liquid conveying pipe 8 with a press fit 25. The nozzles 22 and 24 each have an air distribution disk 26 and 27 respectively.

A nozzle of this type can be fastened with or without an air distributor disk as a press fit to the liquid conveying pipe. The nozzle can be pushed into a recess in the liquid conveying pipe or the liquid conveying pipe is pushed into a recess in the nozzle. The fit is particularly stable if at least one of the two parts has not yet fully hardened when being pushed into each other. The part then hardens after being pushed in and shrinks through which the strength of the fit between the parts is considerably increased. The strength can be increased even further if a small groove or indentation is provided between the parts in order to each a form-fitting connection.

The nozzle or a part of the nozzle can also be made of metal. This makes it possible to produce the contact area between the paint needle tip and the nozzle of metal in order to increase the stability of the nozzle.

A crosspiece 28 with a grip surface 29 extends radially outwards from the liquid conveying pipe 8. This grip surface 29 is arranged in such a way that on screwing on the fastening nut 4 the grip surface 29 is covered by the fastening nut 4. Opposite the grip surface 29 a grip surface 30 is fastened on a crosspiece 31 the other end of which is on a flange 32 extending radially outwards from the liquid conveying pipe 8. Like an air distributor the flange 32 is provided with borings 33.

Arranged in the fastening nut 4 is an air cap 34 with two paint horns 35, 36 so that on screwing on of the fastening nut the air cap 34 is pressed against the liquid conveying device 3. With its oblique contact surface 37 the air cap 34 is in contact with the liquid conveying device 3 in such a way even with the fastening nut 3 screwed on the air cap 34 can still turn. A special fitting at the contact surface 37 defines the force with which the air cap 34 can be turned when the fastening nut 4 is screwed on.

In the assembled spray gun 1 the paint needle 20 extends in a channel 38. This channel 38 is formed by a boring 39 in the bushing 17 in a broadened space 40 in the area of the opening 16 and a bearing in the nozzle 22 and 24. This channel ends at the nozzle tip 42, where the tip 43 of the paint needle 29 is in contact on closing the nozzle and on opening of the nozzle is positioned at a distance from the nozzle tip 42.

This allows liquid, for example a paint, to flow from the tank 5 through the liquid supply pipe 10 and the opening 16 into the broadened space 40 and from there through the boring 41 to the tip 42. Flowing of the liquid into the bushing 17 is prevented by the flange 21 which is firmly in contact with the paint needle 29, but an axial movement of the paint needle 20 is enabled.

When pulling the entire liquid conveying device 3 out of the basic body 2 of the spray gun 1 only one movement in direction of the axial extension of the paint needle 20 is possible. During this the flange 21, annularly in contact with the paint needle 20, is pulled over the front end of the paint needle, wherein liquid or paint adhering to the paint needle is stripped off. The stripped paint needle area then reaches the perforated disk 19 where it may again be stripped of adhering paint.

In the example of embodiment two strippers 19 and 21 are arranged in the bushing 17. Several identical or different strippers of different embodiments can of course be arranged in the bushing 17 in order to clean the colour needle as much as possible on being pulled out of the liquid conveying device 3.

The air cap 34 with the paint horns 35 and 36 is inserted into the fastening nut 4 in a rotatable but unlosable manner. After screwing on the fastening nut 4 the paint horns 35, 36 should be arranged in a certain position (vertical or horizontal). For this locking elements 45, 46 are provided on the air cap 34 on the one hand and on the nozzle 22 or the body 44 of the liquid conveying device 3 which on turning of the air cap 34 noticeably indicate one or more particular positions.

On screwing the fastening nut 4 onto the thread 4 of the basic body 2 the fastening nut 4 moves axially towards an annular surface 47. During this movement towards the surface 47, in a recessed partial area the fastening nut 4 contacts a protruding area 49 of the liquid conveying device 3. This results in that on screwing the fastening nut 4 on the liquid conveying device 3 is pressed into the basic body 2 of the spray gun 1.

In addition pressing of the liquid conveying device 3 when screwing on the fastening nut 4 into the basic surface 2 of the spray gun 1 can take place through a projecting element 50 (only shown schematically), in that the projecting element 50 engages in the thread 51 of the fastening nut 4.

The liquid conveying device 3 should be introduced along the alignment of the paint needle 20 in a centering manner into a recess 52 in the basic body 2 of the spray gun 1.

For this the contact surfaces 53, 54 between the liquid conducting device 3 and basic body 2 are designed to be slightly conical. In FIG. 31 an angle 55, 56 of 1° is given which indicates a conical design. The radially extending surfaces 57 and 58 on the crosspieces 28 and 31 are slightly conical and interact with corresponding conical contact surfaces in the basic body 2 in order to optimally annularly seal the entire contact area between the liquid conveying device and basic body and to position the liquid conveying device to fit precisely when inserting it into the basic body.

When the liquid conveying device 3 is fitted firmly into the basic body 2 and tightened by the fastening nut 4, a secure, tight fit between the basic body 2 and the liquid conveying device 3 is produced. The means that on unscrewing the fastening screw 4 from the basic body 2 the liquid conveying device 3 continues to fit securely in the basic body 2 and has to be pulled out of the basic body 2 with the grip surfaces 29 and 30.

Preferably the fastening nut 4 is made of metal with an annular contact surface of plastic. This plastic contact surface acts on the liquid conveying device 3 when the fastening nut 4 is screwed on and slides along the liquid conveying device 3. When the fastening nut 4 is firmly tightened this plastic contact surface acts as a seal between the liquid conveying device 3 and the fastening nut 4.

Further sealing between the fastening nut 4 and the basic body 2 of the spray gun can be achieved in that on the surface at which the annular side of the fastening nut facing the basic body has a seal, which is then in contact with the basic body when the fastening nut is fully screwed on. Such a seal can also be provided on the contact surface on the basic body, so that when being screwed on the fastening nut 4 moves towards this seal and on being tightened compresses the seal in order to achieve sealing.

In this way a sealed space is provided between the basic body 2 and the fastening 4 in which the spray medium conveying device can be arranged. This space is preferably even sealed up to the contact surface between the paint needle 20 and the opening in the fastening nut that interacts with it.

Pulling the liquid conveying device 3 out of the basic body 2 can be facilitated by a pin 59 which is guided in a boring 60 in the basic body 2 and has a contact surface 61 which acts on a counter-surface 62 on the body 44 of the liquid conveying device 3. The contact surfaces 61 and 62 in the example of the embodiment shown in FIG. 22 are arranged in parallel to each other and in this case at an angle 63 of 65° to the paint needle 20 in order to exert a pressure force 64 with the pin 59 on the liquid conveying device 3.

A pressure force 64 acting decentrally with regard to the alignment of the paint needle in the direction of the central axis 65 of the pin 59 can lead to tilting of the liquid conveying device 3 within the basic body 2. Therefore on the front end of the pin 59 a contact surface 66 is provided decentrally in relation to the central axis 65 of the pin 59 in order to specifically exert a force on the liquid conveying device that is also decentral in relation to the axis 65 of the pin 59. By means of such a pin 59 it is on the one hand possible to arrange the pin 59 decentrally in relation to the paint needle 20 and on the other hand to let the force 64 act on any point or on a defined arc of the liquid conveying device 3 in order to push the liquid conveying device 3 as effectively out of the basic body 2 as possible.

The pin 59 has a circumferential groove 67 in which a retaining ring 68 is arranged, which in turn interacts with a spring 69 in such a way that the pin 59 is pressed into a position in which it does not press against the liquid conveying device 3. The end 70 of the pin 59 thus acts as a button with which ejection of the liquid conveying device 3 can be brought about.

In an alternative form of embodiment, which is not shown, the retaining ring and spring are arranged so that when the spring is relaxed the pin 59 is positioned with its end 70 in the basic body and at the other end hardly or not at all sticks out of the basic body. On insertion of the liquid conveying device 3 the pin 59 is then displaced to the back against spring force so that end 70 appears out of the basic body. This also makes it possible to push the liquid conveying device 3 out of the basic body 2 with the pin 59 after unscrewing the fastening nut 4.

The pin 59 can also pulled away toward the back against the force of a spring 69 by the liquid conveying device 3 so that the pin 59, when released, is accelerated by the force of the spring 69 and quick moves towards the liquid conveying device 3 and thereby pin 59 strikes against the liquid conveying device 3. It has been shown that even a small strike from behind on the liquid conveying device 3, for example with a pin 59 of this type, is sufficient to loosen the liquid conveying device 3 in such a way that is released from the basic body 2 of the spray gun 1.

On insertion of the liquid conveying device 3 the pin can also be pressed into the basic body 2 of the spray gun against a spring force. If the build-up tension is subsequently released, the pin strikes against the liquid conveying device 3 and can thereby release the liquid conveying device 3 from the basic body 2 of the spray gun 1.

Alternatively or additionally the liquid conveying device 3 can also be released by the paint needle 20 from the basic body 2 of the spray gun 1. For this a stop 108 is provided on the paint needle 20 which is arranged so that it can act on the liquid conveying device 3 (see FIG. 42). The paint needle 20 can for example strike on the rear side of the liquid conveying device 3 against the rubber disk 17, the sleeve 19 or in the front area again the nozzle 2 in order to release the liquid conveying device 3 from the basic body 2 of the spray gun 1.

For this basic body 2 can have a trigger (not shown) which moves the paint needle in a usual way. In order to trigger the paint needle 20 striking the liquid conveying device 3 the trigger can be brought into a position in which the paint needle 20 presses against the liquid conveying device 3. Preferably a colour needle 20 pre-tensioned with a spring is released with a trigger so that the paint needle 20 is moved by the spring and strikes the liquid conveying device 3.

The pin 59 and the grip surfaces 29, 30 are thus alternatively or additionally usable means that make it possible to remove the liquid conveying device 3 from the basic body 2.

A strike or a pressure on the liquid conveying device 3 can act on a weakened area of the liquid conveying device in such a way that it is destroyed by the strike. The result of this is that liquid conveying device 3, when it is released from the basic body 2 of the spray gun 1 is altered in such a way that it can no longer be used. The liquid conveying device thereby become a true disposable article as due to the nominal breaking point it can only be used once even in practice. This means that after each removal of the liquid conveying device 2 only a new liquid conveying device 3 can be used so that a clean liquid conveying device 3 is always available.

In design terms this is achieved, for example, in that the paint needle 20 of the pin 59 strikes a surface which is deformed or broken off in such a way that the spray gun is subsequently no longer sealed.

The liquid conveying device 3, the sleeve 17, the nozzles 22 and 24 as well as the air distributors 12, 26 and 27 can be produced as individual component, preferably made of plastic, by injection molding and fastened to each other. Preferably, however, as many of these parts of the liquid conveying device are produced in one piece, preferably through injection molding. FIGS. 32 to 35 show how the bodies 44 of the liquid conveying device 3 can be produced in one piece with a nozzle 71. FIGS. 36 and 37 show that such a nozzle can also comprise an air distributor disk 72. This allows price-effective production of a liquid conveying device 3 as a plastic injection molded component from a single or a multi-component material.

At the transition from the basic body of the spray gun to the air distributor disk and from the air distributor disk to the spray medium conveying device and also directly from the basic body to the spray medium conveying device reliable sealing must be ensured. This sealing can be achieved through simple pressing on of the spray medium conveying device onto the air distributor disk or the basic body of a spray gun as the spray medium conveying device is made of a softer material and in the transition area can also be made softer through its shaping, for example the provision of a fine lip. Below, further types of groove and spring connection are shown in the case of each of which the groove can be arranged at the point at which the spring is shown.

FIG. 38 shows in detail the radially projecting element 80 which in the area of its face end contact has an oblique fit or even a groove and spring connection 81 to ensure sealing. Details of the connection between the air distributor disk 82, 83 and a spray medium conveying device 84, 85 are shown in FIGS. 40 and 41. FIG. 40 shows a sealing ring with a chamfered cone 86 and chamfered spring 87 and FIG. 41 show a sealing ring with a stepped spring 88 which engages in stepped groove 89. The design of the groove and spring can, as shown in FIG. 40, also help to centre the components in a simple manner.

In the spray gun shown in FIG. 42 the lower pull loop has been eliminated. This facilitates sealing in this area. Only a small crosspiece 90 remains, the lower side 91 of which is designed so that the crosspiece 90 narrows towards the spray gun in order to center the spray medium conveying device 92 when being inserted into the basic body 93. This crosspiece 90 can also be omitted to facilitate annular sealing. FIG. 43 shows such a continuous seal in the lower area 94 which is only interrupted at the upper side 95 as it is there that the spray medium inlet 97 is pushed into the corresponding receptacle 96 of the spray gun 98.

On the receptacle 96 a projection 106 is indicated in FIGS. 43 and 44 as a circumferential line which is provided on the inside of the receptacle 96 on the spray gun. This projection 106 corresponds with a project 107 on the spray medium conveying device 92. This project can serve as a contact surface for a spray medium tank (not shown). It is advantageous if the projection 106 is at least in parts designed as a protruding element which positively interacts with a corresponding recess on the spray gun. The projecting element can, for example, be a circumferential elevation which interacts with a corresponding groove in the spray gun. However, other elements such a as peg and hole, can act as the positive connection. Accordingly the element can also protrude on the spray gun with a corresponding recess being provided on the spray medium conveying device.

A positive or also a non-positive connection between the spray gun and spray medium conveying device ensures that the liquid conveying device is also held in the axial direction of the spray medium inlet 97 against a tensile or pressure force. This connection can hold the spray medium conveying device on the spray medium inlet 97 in such a way that the forces acting from a paint tank on the spray-medium conveying device are already intercepted in the area of the spray medium inlet 97.

FIG. 44 shows a spray gun 100 with a basic body 101 in which an air distributor disk 102 is inserted. In order to seal the air distributor disk 102 with regard to the basic body 101 a groove 103 is provided in the basic body 101 into which a circumferential crosspiece 104 of the air distributor disk 102 engages. On pushing the spray medium conveying device 105 towards the basic body 101 the air distributor disk 102 is pushed against the basic body 101 and crosspiece 104 into the groove 103.

In practice nozzles 71 with borings 73 with different boring diameters 74 are required. It is therefore proposed to produce spray medium conveying devices 3 with different boring diameters and in order to differentiate spray medium conveying devices with different boring diameter to colour them differently or to make them of differently coloured materials, in particular differently coloured plastics. The spray medium conveying devices could be made in the same colour and only the nozzle could be of a different colour. The nozzle can either be undetachably connected to the body of the spray medium conveying device press fitting or interchangeably inserted into the body with a thread.

Alternatively a set with a liquid conveying device and several different nozzles 22 can be produced which fit in the liquid conveying pipe 8 of the liquid conveying device 3 and have different boring diameters and possibly also different air distributor disks 72. Here it is advantageous if the different nozzles 22 are of different colors or are made of differently colored plastic materials. The nozzles 22 can also be made of a metal and screwed into or otherwise fastened in body 44 of a liquid conveying device 3. If the nozzle is undetachably connected with the body of the spray medium conveying device, different spray medium conveying devices which have the same body but different nozzles can be provided in the color matching the nozzle as a set. Preferably the body of the spray medium conveying is black and the nozzles are of different colors.

The spray gun 110 shown in FIG. 46 has a basic body 111, liquid conveying device 112 and an air cap 113. The liquid conveying device 112 has an air distribution disk 114 with a cover 115 in which an opening 116 for a paint needle 117 is provided. Below it is an air opening 118 for the air supplied via the basic body 111 of the inner air chamber to convey the liquid and an air opening 119 as an inlet for the air supplied from the basic body of the outer air chamber for forming the spray jet.

This results in an encapsulated liquid conveying device 112 which has two inlets 118 and 119 for the air supplied via the basic body 111 of the spray gun and an inlet for the passage of the paint needle 117. Sealing of the air supplied via the basic body 111 takes place at the air openings 118 and 119 which in the example of embodiment are in the form of small pipe pieces which can be inserted into corresponding openings in the basic body of the liquid conveying device. The air cap 113 is put over the liquid conveying device 112 and screwed onto the basic body 111 in order to hold the liquid conveying device 112 firmly on the basic body 111.

FIGS. 48 to 51 show a variant of embodiment of the spray gun 120 in which an air distribution disk 121 is inserted in to the basic body 122 of the spray gun 120 and fastened there by means of screws 123 or interlocking. The air distributor disk 121 thereby becomes part of the basic body 122 and is no longer, as occurs in the previously-shown examples, a part of the liquid conveying device 124.

The air distribution disk 121 has annular sealing crosspieces 125, 126, and 127 which interact with a corresponding structures, for example a respective groove 128, 129, 130 on the liquid conveying device 124 in order to delimit the air channels 132, 133, For this the liquid conveying device 124 has a cover 131 which together with the air distribution disk 121 forms and seals the air channels 132 and 133. The crosspieces 125 to 127 can be arranged either on the air distribution disk 121 or on the cover 131. It is preferable if the crosspieces made of a harder metal, such as aluminum or hard plastic interact with grooves of a softer material to ensure good sealing. Here, the crosspieces are preferably arranged on the air distribution disk 121 whereas the grooves are provided on the cover 131. The seal between a crosspiece and a corresponding counter-structure can be improved by a sealing material provided by way of dual component injection molding on the cover 131 and/or on the air distribution disk 121. It is advantageous if adequate sealing is achieved solely through the shape of the crosspiece and groove.

In the example of embodiment shown in FIG. 48 the cover 131 has three grooves 128, 129 and 130 between which are formed two annular surfaces which are elevated with regard to the surface of the grooves and have air holes which are placed between the annular crosspieces 125 to 127 in such a way that they seal like a stopper. Between the contact surfaces of the groove and crosspiece, conicity can be provided which facilitates insertion and on pressing the cover 131 onto the air distribution disk 121 ensures a secure seal.

The spray medium flows into the liquid conveying device 124 at the spray medium inlet 134. From there the spray medium enters a constricted channel 135 in which the spray medium flow towards the paint needle 136. A wall 137 prevents the spray medium reaching the paint needle channel 138 from the channel 135 arranged at an acute angle to the paint needle 136. From the channel 135 the spray medium enters a paint channel 139 running in parallel to the paint needle 136 which is also separated from the paint needle channel by a wall 137.

Hitherto it was usual to let the spray medium flow in a straight line from the spray medium inlet 134 to the paint needle so that as few surfaces of the liquid conveying device as possible are wetted by the spray medium and the path of the spray medium to the paint needle is kept as short as possible. This means that the spray medium reaches the nozzle in a longer paint channel from the basic body of the spray gun along the paint needle and in this area wets the paint needle and channel of the liquid conveying device. In another known form of embodiment the spray agent inlet is close to the nozzle so that the spray agent only wets the liquid conveying device and the paint needle in the area of shorter paint channel. However, this results in the centre of gravity of the spray gun being displaced towards the nozzle.

In the example of embodiment shown in FIG. 48 to 51 the spray medium inlet 134 is in an area surrounded by the basic body 122 of the spray gun 120. However, the spray medium 150 which is to flow from the spray medium inlet in a straight line into the liquid conveying device 124 and from there in the direction of the paint needle 136 cannot reach the paint needle on this line and is diverted into a paint channel 139 running parallel to the paint needle, in which, parallel to the paint needle it reaches the paint nozzle through a wall 137 at a distance from the paint needle.

This means that although the spray medium is conveyed within the basic body 122 of the spray gun 120, the paint needle comes into so little contact with the spray medium that cleaning of the needle is also possible without it having to be removed.

In comparison with the example of embodiment shown in FIG. 2, in the example of embodiment shown in FIGS. 48 to 51 no bushing 17 is required as this area can be injection molded in one piece with the remainder of the liquid conveying device.

The liquid therefore flows in the liquid conveying device 124 separated by the wall 137 from the paint needle 136 to the liquid outlet 140, where the liquid flows out of the liquid conveying device 124 and into the spray nozzle 141.

At this point the liquid flow from the paint channel 139 radially removed from the paint needle 136 into a keyhole-shaped area to the paint needle 139 and from there concentrically around the paint needle 139 into the nozzle 141. This area can be provided as a keyhole-shaped recess in the liquid conveying device 124 and interact with a keyhole-shaped crosspiece 142 on the nozzle 141 so that the liquid is transferred into the nozzle 141 from the liquid conveying device 124 in a sealed channel, Radially outside the nozzle 141 conveying air is supplied to the liquid in an inner air chamber, which by way of the Venturi principle produces a spray jet and in an outer air chamber air for forming the spray jet is conveyed from the liquid conveying device 124 into the air cap 143 from where it reached the paint horns 144 and 145.

To prevent the leakage of air for forming the spray jet from the outer air chamber and thus from the spray gun, on the outer circumference of the liquid conveying device 124 a sealing surface 146 is provided which interacts with a sealing surface 147 arranged in the air cap 143. For this, for example, a sealing ring can be provided in the air cap 143. However, sealing can also be provided on the liquid conveying device which interacts with the air cap 143.

Thus only after emerging from the paint needle channel 138 does the paint needle 136 come into contact with the spray medium 150. The consequence of this in practice is that only the front part of the paint needle 136 comes into contact with the spray medium through which the area of the paint needle to be cleaned is considerably reduced. To facilitate the cleaning of this area of the tip 148 of the paint needle 136 too, an annular stripper 149 is provided at the outlet of the paint needle 136 from the liquid conveying device 124. When the liquid conveying device 124 is pulled off the paint needle 136, the stripper 149 scrapes over the front end 148 of the paint needle 136 in order to clean the paint needle.

Figure 52:
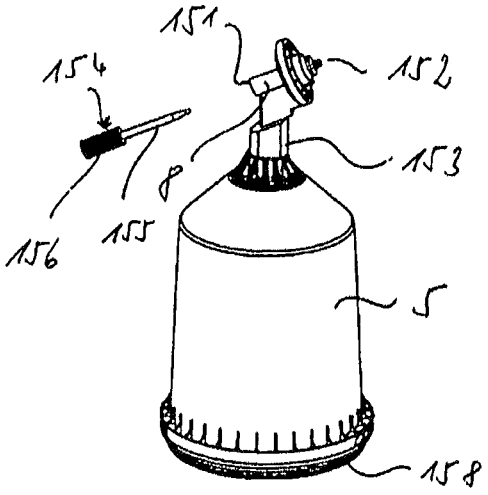

FIG. 52 shows the liquid conveying device with an inlet 151 and an outlet 152 as well as a connection 153 to a paint tank 5. Between the inlet 151 and the outlet 152 there is a liquid conveying pipe 8 of which at least one part is wetted with the paint or liquid during spraying. As the connection to the paint tank 5 is airtight, in this case in the form of a screw closure, the air tank is closed in an airtight manner if the inlet 151 and the outlet 152 are closed in an airtight manner. Used for this is the closure device 154 which in this case is in the form of spike 155 and grip 156. The spike 154 is so long that it does not only close the inlet 151, but also the outlet 152 at the same time when it is arranged in the paint channel 8.

The paint tank is designed as a flow tank 5 with an air after-flow opening 157, which in this case is arranged in the cover 158 of the tank 5 and can be opened during spray for the inflow of air, whereas it is closed during storage of the spray medium.

FIG. 56 shows the interaction of a spike 160 with a liquid conveying device 161. In the direction of the supplied air and in the direction of the supplied liquid, which is generally a paint, varnish or filler, the spike 160 is inserted so far into the liquid conveying device until a stop 162 is reached. To hold the spike securely a blind hole 163 is provided into which fits an area 164 of the spike reduced in diameter.

The spike 160 has a structured grip section 165, opposite this grip 165 a nozzle 166 is provided on the liquid conveying device 161. This nozzle 166 is connected to the liquid conveying device 161 by means of a fitting 167.

So that the liquid conveying device can interact in a sealing manner with an air distributor ring 121, on its rear side slightly conical areas 168 at 10° and a notch 169 are provided with which the liquid conveying device can engaged like a stopper in recesses in an air distributing ring 121.

During spraying with the liquid conveying device, paint reaches the paint needle within the liquid conveying device. To keep this area as small as possible, as shown in FIG. 60 as part of the liquid conveying device 173 a paint needle cover 170 is provided which projects in a conically narrowing manner into the liquid area 171 toward the nozzle 172 as a conically formed tip. As a paint needle cover, this tip covers a part of the paint needle passing through the liquid area so that only a very small area of the paint needle (not shown) comes into contact with the liquid. This means that after removal of the liquid conveying device 173 from the basic body of the spray gun the paint needle is wetted with as little liquid as possible and that this area is easily accessible from the outside for cleaning.

The transition between the spray medium conveying device, the basic body of the spray gun and the paint tank is designed so that a screwed on or mounted paint tank can be directly supported on the spray gun basic body. A force between the paint tank and spray medium conveying device is thus minimised as the outlet of the paint tank has a contact surface which is in contact with a contact surface of the basic body of the spray gun when the paint tank is mounted. This also means that that the transition to the paint the spray medium conveying device is surrounded and stabilised by the basic body of the spray gun. If the spray medium conveying device and the paint tank are made of plastic and the spray gun basic body of metal, the metal area of the basic body of the spray gun protects the spray medium conveying device.

It is advantageous if the spray medium conveying device can only be pushed so far onto the needle that it is not completely in mounted on the basic body of the spray gun. The tip of the needle acts as a stop and prevents the spray medium conveying device bent pushed further towards the basic body of the spray gun. Only when the needle is pulled back by means of the grip on the basic body of the spray gun does the spray medium conveying device slide into position on the contact surface on the basic body of the spray gun. The paint conveying device can also be pressed against the paint needle with the fastening nut so that the paint needle is pressed into the basic body of the spray gun and the spray medium conveying device slides into position on the contact surface on the basic body of the spray gun. The grip of the basic body of the spray gun is also pressed back slightly through this.

Of particular importance is the contact surface between the paint needle and the spray medium conveying device. If the paint needle has a cylindrical section in the area in which it can be arranged in the spray medium conveying device, the paint needle can be retracted within the spray medium conveying device so that passage to the nozzle is cleared without the conical tip of the paint needle being pulled into the spray medium conveying device. Through this, only a cylindrical section of the paint needle moves with the spray medium conveying device which prevents spraying medium from being pulled into the spray medium conveying device between the paint needle and paint conveying device at the forward area of the paint needle and wetting the inner surface of the spray medium conveying device with paint.

In the front area of the contact surface between the spray medium conveying device and paint needle a stripper can also be provided. For this annular inwardly projecting flange is formed on the spray medium conveying device which is in contact with the paint needle. In the contact area a circumferential groove can also be provided to improve stripping of paint and to prevent spray medium adhering to the paint needle entering the spray medium conveying device.

The space in which the spray medium flow from the paint tank to the nozzle can be enlarged in that the forward area of the spray medium conveying device surrounding the paint needle is cylindrical on the inside and conically tapers towards the nozzle on the outside.

FIG. 61 shows how the paint tank 180 is in contact with a circumferential contact surface 181 on the basic body 182 of the spray gun 183. FIG. 62 shows a conical area 190 on the outside of the spray medium conveying device 191. Through this the passage 192 for spray medium is enlarged. A stripper 200 at the contact between the spray medium conveying device 201 and paint needle 202 is shown in FIG. 63 with detail shown in FIG. 64. A space 203 between the spray medium conveying device 201 and the paint needle 202 extends to the stripper 200 which interacts with a small groove 204.

An essential aspect of the invention is the air-tight seal between the paint conveying device and the basic body or an air distributor disk attached to the basic body. For this an elevation is provided on the paint conveying device in which at least one passage is arranged. The elevation fits like a cork into a recess on the basic body or on a component of the basic body. When the paint conveying device and basic body or component of the basic body are pushed onto each other the elevation slides into the recess so that a seal is formed between the parts. The elevation thus acts as a seal with a passage. Here it is clear that the elevation can also be arranged on the basic body or component of the basic body if a corresponding recess is provided in the paint conveying device. It is advantageous if at least one of the parts is made of material that is so elastic that sealing is facilitated. For example the paint conveying device can be made of a plastic and the basic body or the component of the basic body or metal or a harder plastic than the plastic of the paint conveying device. The elevation and recess can each be conically formed so that the elevation can slide so far into the recess that a good seal is formed. However, only one conical insertion area can be provided which becomes a cylindrical area so that sealing at least also takes place on the cylindrical contact surface.

One example of embodiment is shown in FIGS. 58 and 59 as well as in FIGS. 65 to 67. An almost annular elevation 205 with openings 206 to 216 concentrically surrounds a further almost annular elevation 217 with openings 218 to 224. A component 226 of the basic body has corresponding almost annular recesses 227 and 228. Slightly conical contact surfaces 229 to 232 allow the elevations 205 and 217 to slide into the recesses 227 and 228 and seal the contact surfaces 229 to 232, while openings 206 to 216 and 218 to 224 allow for an externally sealed passage from the basic body of the spray gun 225 to the air cap 233. Depending on the variant of embodiment just one elevation with a corresponding receptacle and individual shape can be provided.

In the area of the liquid supply pipe 234 the paint conveying device 237 has a projection 235 in contact with the basic body of the spray gun. A further projection 236 serves as the contact surface for a screwed on paint tank. These contact surfaces 235 and 236 are arranged at an acute angle to one another so that the paint conveying device 237 can be easily pushed onto the basic body of the spray gun 225, while the paint tank can be screwed onto the slightly angled liquid supply pipe. With this screwing on, the paint tank is held firmly on the paint conveying device and the paint conveying device is supported, when pushed onto the basic body of the paint spray gun, on the basic body of the paint spray gun at the contact surface formed between the paint conveying device and the basic body.

The invention claimed is:

1. A spray gun comprising:

a basic body, and a liquid conveying device comprising a first liquid conveying pipe having a longitudinal axis, a liquid supply pipe disposed at a rearward angle relative to the longitudinal axis which liquid supply pipe opens into the first liquid conveying pipe, and a liquid supply device housing, wherein the basic body comprises a contact plate comprising a first contact surface, a second contact surface, and a first recess between the first and the second contact surfaces, wherein the liquid conveying device extends through a top portion of the contact plate, wherein the first and the second contact surfaces are arranged conically, wherein between the first and the second contact surfaces at least one first passage is arranged in the contact plate parallel to the longitudinal axis, wherein the liquid supply device housing comprises a first elevation, the first elevation having conical contact surfaces, and wherein the basic body and the liquid supply device housing are connected to each other such that the conical contact surfaces of the first elevation oppose, interact with, and seal the first and the second contact surfaces, the first elevation engaging in the first recess of the contact plate.

2. The spray gun according to claim 1, wherein the liquid supply device housing comprises at least one second passage arranged in the first elevation.

3. The spray gun according to claim 1 further comprising a fastening nut, wherein the basic body has a thread configured to receive a fastening nut for fastening the liquid conveying device to the basic body, and wherein the thread has a recess and the liquid conveying device has at least one protruding element which protrudes radially from the central liquid supply pipe and fits into the recess so that after unscrewing the fastening nut the liquid conveying device can be grasped on the protruding element to pull the liquid conveying device from the basic body.

4. The spray gun according to claim 1, the liquid conveying device further comprising:

a paint needle channel, and a paint channel for a spraying medium, wherein the paint channel is radially spaced from the paint needle channel.

5. The spray gun according to claim 4, the liquid conveying device further comprising a wall, an outlet, and a paint needle in the paint needle channel, wherein the paint channel extends from the liquid supply pipe up to the outlet, wherein the wall separates the paint channel from the paint needle channel, and wherein the paint channel runs parallel to the paint needle.

6. The spray gun according to claim 4, further comprising a stripper between the paint needle channel and the paint channel.

7. The spray gun according to claim 1, further comprising a nozzle in the first liquid conveying pipe, wherein the liquid supply pipe opens into the first liquid conveying pipe via an opening, and wherein in a direction of flow the nozzle is arranged after the opening.

8. The spray gun according to claim 1, wherein the first liquid conveying pipe has a flange with air borings which extends radially outwards.

9. The spray gun according to claim 1, further comprising a cover, wherein the contact plate is an air distribution disk, and wherein the first elevation is an annular crosspiece designed to interact with the cover to seal the at least one first passage.

10. The spray gun according to claim 1, wherein the liquid supply device housing comprises a cover, and wherein the cover comprises the first elevation.

11. The spray gun according to claim 1, wherein the basic body is made of metal and the liquid conveying device is made of a plastic material.

12. A spray gun comprising:

a basic body, and a liquid conveying device comprising a first liquid conveying pipe having a longitudinal axis, a liquid supply pipe disposed at an angle relative to the longitudinal axis, which liquid supply pipe which opens into the first liquid conveying pipe, and a liquid supply device housing, wherein the basic body comprises a contact plate comprising a first contact surface, a second contact surface, and a first recess between the first and the second contact surfaces, wherein the liquid conveying device extends through a top portion of the contact plate, wherein the first and the second contact surfaces are arranged conically, wherein between the first and the second contact surfaces at least one first passage is arranged in the contact plate parallel to the longitudinal axis, wherein the liquid supply device housing comprises a first elevation, the first elevation having conical contact surfaces, and wherein the basic body and the liquid supply device housing are connected to each other such that the conical contact surfaces of the first elevation oppose, interact with, and seal the first and the second contact surfaces, the first elevation engaging in the first recess of the contact plate.

* * * * *